US006155664A

United States Patent [19]

Cook

[11] Patent Number: 6,155,664

[45] Date of Patent: Dec. 5, 2000

[54] OFF-CARRIER INKJET PRINT SUPPLY WITH MEMORY

[75] Inventor: William Paul Cook, Lexington, Ky.

[73] Assignee: Lexmark International, Inc., Lexington, Ky.

[21] Appl. No.: 09/100,042

[22] Filed: Jun. 19, 1998

[51] Int. Cl.[7] ..... B41J 2/175

[52] U.S. Cl. ..... 347/7; 347/19

[58] Field of Search ..... 347/7, 19, 85, 347/86; 399/238, 258, 260, 27

[56] References Cited

U.S. PATENT DOCUMENTS

| | | | |
|---|---|---|---|
| 5,266,975 | 11/1993 | Mochizuki et al. | 346/140 |
| 5,367,328 | 11/1994 | Erickson | 347/7 |
| 5,386,224 | 1/1995 | Deur et al. | 347/7 |
| 5,504,507 | 4/1996 | Watrobski et al. | 347/19 |
| 5,506,611 | 4/1996 | Ujita et al. | 347/96 |
| 5,606,353 | 2/1997 | Mochizuki et al. | 347/23 |
| 5,610,635 | 3/1997 | Murray et al. | 347/7 |
| 5,625,384 | 4/1997 | Numata et al. | 347/23 |
| 5,629,727 | 5/1997 | Erickson | 347/85 |
| 5,686,947 | 11/1997 | Murray et al. | 347/85 |
| 5,699,091 | 12/1997 | Bullock et al. | 347/19 |
| 5,757,390 | 5/1998 | Gragg et al. | 347/7 |
| 5,788,388 | 8/1994 | Cowger et al. | 400/703 |
| 5,792,380 | 8/1998 | Wen et al. | 252/62.56 |

FOREIGN PATENT DOCUMENTS

| | | | |
|---|---|---|---|
| 0 729 834 A1 | 9/1996 | European Pat. Off. | B41J 2/175 |

*Primary Examiner*—John Barlow
*Assistant Examiner*—Craig A. Hallacher
*Attorney, Agent, or Firm*—Luedeka, Neely & Graham

[57] ABSTRACT

The invention ensures the proper operation of an inkjet printer by determining whether ink contained within a remote ink cartridge is compatible with ink contained within a printhead cartridge, and controlling the printer accordingly. The invention determines compatibility by comparing information related to characteristics of the ink contained in each cartridge. The printhead cartridge memory device stores information relating to characteristics of the printhead and the ink stored in a printhead cartridge reservoir. The remote ink cartridge memory device stores information relating to characteristics of the ink stored in a remote ink cartridge reservoir. Since the number of characteristics that can be stored is determined by the capacity of the memory devices, the present invention overcomes the limitations of prior devices which forced compatibility by mechanical devices. The remote ink cartridge memory device also provides a member for storing information, such as a drop count value, which indicates the amount of ink remaining in the remote ink cartridge reservoir.

66 Claims, 7 Drawing Sheets

Mechanical Block Diagram

OFF-CARRIER INKJET PRINT SUPPLY WITH MEMORY

FIELD OF THE INVENTION

The present invention is generally directed to inkjet printers, and is more particularly directed to a method and apparatus for controlling an inkjet printer based upon compatibility between a primary ink supply in a print cartridge and a secondary, off-carrier ink reservoir.

BACKGROUND OF THE INVENTION

Thermal inkjet printers apply ink to a print medium by ejecting small droplets of ink from an array of nozzles located in a printhead of a print cartridge. An array of thin-film resistors on an integrated circuit on the printhead selectively generates heat as current is passed through the resistors. The heat causes ink contained within an ink reservoir adjacent to the resistors to boil and be ejected from the array of nozzles associated with the resistor array. A printer controller determines which resistors will be "fired" and the proper firing sequence so that the desired pattern of dots is printed on the medium to form an image.

Typically, replaceable printhead cartridges include integrated ink reservoirs. Due to weight limitations, these reservoirs usually contain much less ink than the printhead is capable of ejecting over its intrinsic lifetime. The useful lifetime of a printhead cartridge can be extended significantly if the integrated ink reservoir can be refilled. Several methods now exist for supplying additional ink to the printhead after the initial supply in the integrated reservoir has been depleted. Most of these methods involve continuous or intermittent siphoning or pumping of ink from a remote ink source to the print cartridge. The remote ink source is typically housed in a replaceable ink cartridge which is "off-carrier", meaning it is not mounted on the carriage which moves the printhead cartridge across the print medium. The ink usually travels from the remote ink cartridge to the printhead cartridge through a flexible conduit.

One problem associated with refillable printhead cartridges is the possibility of refilling the cartridge with ink of a color that does not match the color of the original ink. Mismatched ink colors can lead to unfortunate results, especially when the cartridge refill occurs during an ongoing multicolor printing task. Mismatched ink formulations, such as dye-based ink mixed with pigment-based ink, can also lead to undesirable results.

Such problems have been addressed in the past by provision of mechanical features to force compatibility between the printhead cartridge and the off-carrier ink cartridge. Such mechanical features have been added to the printhead cartridge, the off-carrier ink cartridge, or both. However, as the number of ink colors and special ink formulations increase, mechanical systems become inadequate to provide for all possible combinations. Therefore, a means of assuring compatible combinations of printhead cartridges and remote ink cartridges is needed.

SUMMARY OF THE INVENTION

The foregoing and other needs are met by an apparatus which compares characteristics of an inkjet printhead cartridge with characteristics of a remote ink cartridge. The apparatus includes a printhead which is disposed on the inkjet printhead cartridge. The printhead has an array of nozzles. Each nozzle has an ejection element for causing ink in the nozzle to be ejected from the nozzle and onto a print medium. The apparatus also has a primary ink reservoir disposed on the inkjet printhead cartridge. The primary ink reservoir contains a first quantity of ink which is in fluid communication with the array of nozzles. A printhead memory device, which is disposed on the inkjet printhead cartridge, stores first information related to characteristics of the printhead cartridge. A secondary ink reservoir, disposed on the remote ink cartridge, contains a second quantity of ink in intermittent fluid communication with the primary ink reservoir. A remote ink cartridge memory device, disposed on the remote ink cartridge, stores second information related to characteristics of the remote ink cartridge. A printer controller interfaces with the printhead, the printhead memory device, and the remote ink cartridge memory device. The printer controller accesses the first information from the printhead memory device, accesses the second information from the ink cartridge memory device, and compares the first information to the second information. Based on the comparison of the first information to the second information, the printer controller determines the compatibility of the printhead cartridge and the remote ink cartridge, and generates control signals according to the compatibility of the printhead cartridge and the remote ink cartridge.

Thus, the present invention ensures the proper operation of the inkjet printer by determining the compatibility of a printhead cartridge and a remote ink cartridge, and controlling the printer accordingly. The invention determines compatibility by comparing each cartridge's characteristics which are stored in the memory device of the respective cartridge. Since the number of characteristics that can be stored is determined by the capacity of the memory devices, the present invention overcomes the limitations of prior devices which forced compatibility by mechanical means.

In another aspect, the invention provides another apparatus for comparing characteristics of an inkjet printhead cartridge with characteristics of a remote ink cartridge. The apparatus includes a printhead disposed on the printhead cartridge. The printhead has an array of nozzles, each having an ejection element for causing ink in the nozzle to be ejected from the nozzle and onto a print medium. A primary ink reservoir, disposed on the printhead cartridge, contains a first quantity of ink in fluid communication with the array of nozzles. A printhead cartridge memory device, which stores first information related to characteristics of the printhead cartridge, is disposed on the printhead cartridge. A secondary ink reservoir, disposed on the remote ink cartridge, contains a second quantity of ink in intermittent fluid communication with the primary ink reservoir. A remote ink cartridge memory device, which stores second information related to characteristics of the remote ink cartridge, is disposed on the remote ink cartridge. A printer controller interfaces with the printhead, the printhead cartridge memory device, and a remote ink cartridge processor. The printer controller accesses the first information from the printhead cartridge memory device. A remote ink cartridge processor on the remote ink cartridge interfaces with the remote ink cartridge memory device and the printer controller. The remote ink cartridge processor accesses the first information from the printer controller and accesses the second information from the remote ink cartridge memory device. The remote ink cartridge processor compares the first information to the second information, determines the compatibility of the printhead cartridge and the remote ink cartridge, and generates printer control signals according to the compatibility of the printhead cartridge and the remote ink cartridge.

In yet another aspect, the invention provides an apparatus for storing information relating to amounts of ink contained within an inkjet printhead cartridge and within a remote ink cartridge. The apparatus includes a primary ink reservoir on the printhead cartridge containing a first quantity of ink. A printhead cartridge memory device on the printhead cartridge stores a stored primary ink level value related to the level of the first quantity of ink. A secondary ink reservoir on the remote ink cartridge contains a second quantity of ink in intermittent fluid communication with the primary ink reservoir. A remote ink cartridge memory device on the remote ink cartridge stores a stored secondary ink level value related to the level of the second quantity of ink. A printer controller interfaces with the printhead cartridge memory device and the remote ink cartridge memory device. The printer controller accesses the stored primary ink level value from the printhead cartridge memory device and accesses the stored secondary ink level value from the remote ink cartridge memory device. The printer controller determines the level of the first quantity of ink based on the stored primary ink level value, determines the level of the second quantity of ink based on the stored secondary ink level value, and generates printer control signals according to the levels of the first and second quantities of ink.

In a further aspect, the apparatus includes at least one primary ink level sensor on the primary ink reservoir. The primary ink level sensor produces a primary ink level signal related to the level of the first quantity of ink. A printhead cartridge ink level sensing circuit is electrically connected to the primary ink level sensor, and receives the primary ink level signal from the primary ink level sensor. The printhead cartridge ink level sensing circuit determines a measured level of the first quantity of ink based on the primary ink level signal, and generates a measured primary ink level value indicative of the measured level of the first quantity of ink. The printer controller receives the measured primary ink level value from the printhead cartridge ink level sensing circuit.

In another aspect of the invention, the apparatus includes at least one secondary ink level sensor on the secondary ink reservoir which produces a secondary ink level signal related to the level of the second quantity of ink. A remote ink cartridge ink level sensing circuit, which is electrically connected to the at least one secondary ink level sensor receives the secondary ink level signal, determining a measured level of the second quantity of ink based on the secondary ink level signal, and generates a measured secondary ink level value indicative of the measured level of the second quantity of ink. The printer controller receives the measured secondary ink level value from the remote ink cartridge ink level sensing circuit.

In a further aspect, the present invention provides an ink cartridge which is remotely located relative to an inkjet printhead in an inkjet printer. The ink cartridge includes a secondary ink reservoir containing ink for use in the inkjet printer, and a memory device which stores information related to characteristics of the ink. The reservoir also includes a computer processor which interfaces with the memory device and with a printer controller in the inkjet printer, and which determines whether the ink contained within the reservoir is compatible with the printhead.

In yet another aspect, the invention provides a method of controlling an inkjet printer having multiple ink reservoirs supplying ink to a single printhead. First information, indicative of characteristics of a first quantity of ink, is stored in a first memory device. Second information, indicative of characteristics of a second quantity of ink, is stored in a second memory device. The first memory device is accessed to retrieve the first information, and the second memory device is accessed to retrieve the second information. The characteristics of the first quantity of ink are determined based upon the first information, and the characteristics of the second quantity of ink are determined based upon the second information. The characteristics of the first quantity of ink are then compared with the characteristics of the second quantity of ink. The compatibility of the first quantity of ink with the second quantity of ink is determined based upon the comparison of the characteristics of the first quantity of ink with the characteristics of the second quantity of ink. A printer control signal is then generated based upon the compatibility of the first quantity of ink with the second quantity of ink, and the printer is controlled in response to the printer control signal.

In a further aspect, the invention provides a method of controlling an inkjet printer having a primary ink reservoir containing a first quantity of ink and a secondary ink reservoir containing a second quantity of ink. First information, indicative of a level of the first quantity of ink, is stored in a first memory device. Second information, indicative of a level of the second quantity of ink, is stored in a second memory device. The first memory device is accessed to retrieve the first information, and the second memory device is accessed to retrieve the second information. The stored level of the first quantity of ink is determined based upon the first information, and the stored level of the second quantity of ink is determined based upon the second information. The stored level of the first quantity of ink is compared to a first minimum value, and the stored level of the second quantity of ink is compared to a second minimum value. Ink is transferred from the secondary ink reservoir to the primary ink reservoir when the stored level of the first quantity of ink is less than the first minimum value. Printer operation is continued when the stored level of the first quantity of ink equals or exceeds the first minimum value. Printer operation is stopped and user intervention is elicited when the stored level of the second quantity of ink is less than the second minimum value.

In yet another method of controlling an inkjet printer having a remote ink reservoir supplying ink to a printhead cartridge, a first identification number is stored in a first memory device on the printhead cartridge, and a second identification number is stored in a second memory device in the remote ink reservoir. The first memory device is accessed to retrieve the first identification number, and the second memory device is accessed to retrieve the second identification number. The first identification number is compared to the second identification number, and the compatibility of the printhead cartridge with the remote ink reservoir is determined based upon the comparison of the first identification number to the second identification number. A printer control signal is generated based upon the compatibility of the printhead cartridge with the remote ink reservoir, and the printer is controlled in response to the printer control signal.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
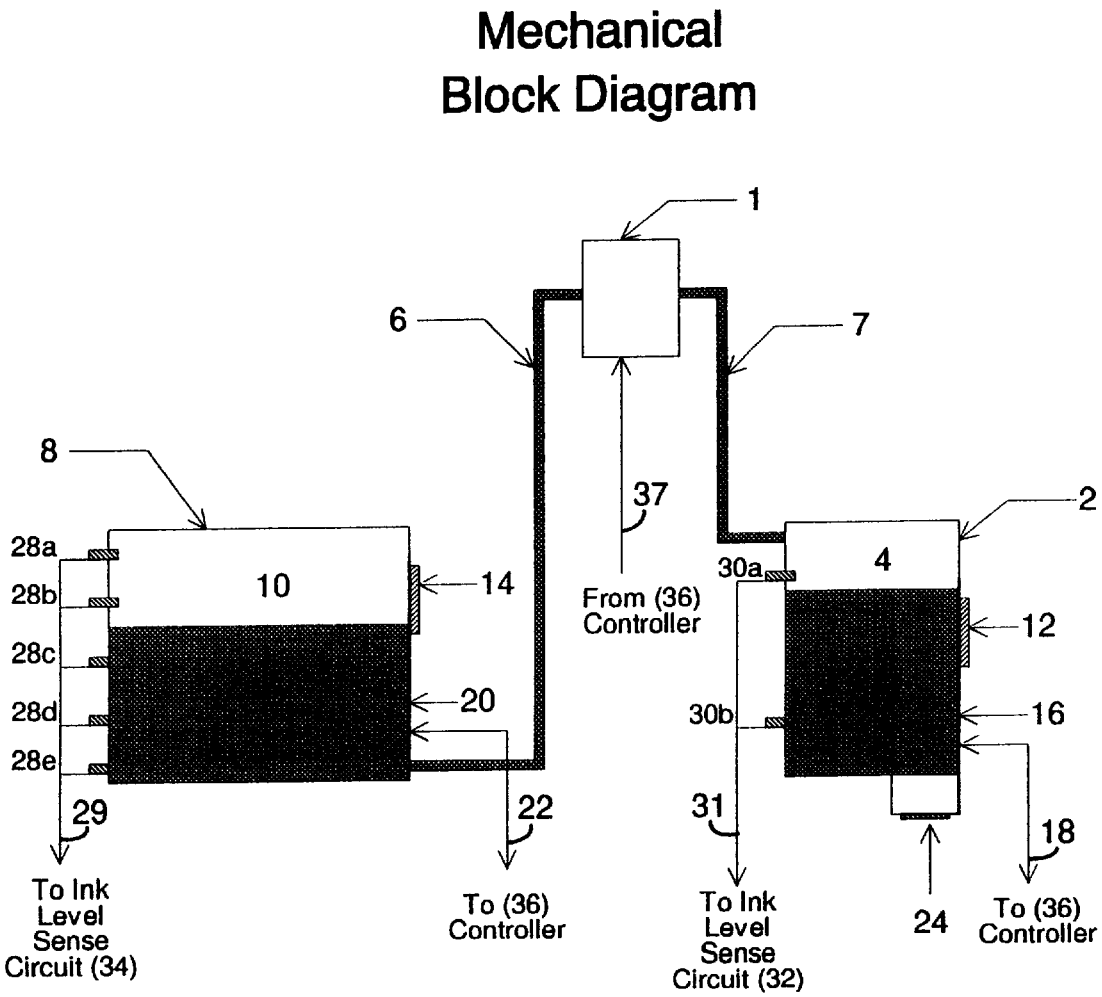
FIG. 1 is a block diagram of an apparatus for transferring ink from a remote ink cartridge to a printhead cartridge.

Shown in FIG. 1 is an inkjet printhead cartridge 2 having a printhead 24 which is composed of an array of ink ejection elements. The ejection elements are adjacent to an array of nozzles in the printhead 24. When current is selectively applied to an ejection element, the ejection element generates heat which boils ink in an adjacent nozzle. The ink is then ejected, or fired, from the nozzle onto a print medium which is adjacent to the printhead 24.

The printhead cartridge 2 includes an integral primary ink reservoir 4 containing a first quantity of ink that is supplied to the nozzles in the printhead 24. In a preferred embodiment of the invention, the printhead cartridge 2 is attached to a carriage which, during a printing operation, moves the printhead cartridge 2 back and forth across a print medium. Due to limitations on the size of the motor that drives the carriage, and limitations on the amount of power that the motor may consume, it is desirable to keep the weight of the printhead cartridge 2 to a minimum. Thus, the amount of ink which can be carried in the primary ink reservoir 4 is limited. Typically, the maximum amount of ink which can be stored in the primary ink reservoir 4 is considerably less than the amount of ink that the printhead can eject during its usable lifetime. Therefore, a remote secondary ink reservoir 10 containing a second quantity of ink, which is enough ink to refill the primary ink reservoir 4 one or more times, is provided off the carriage on a stationary printer structure.

The secondary ink reservoir 10 is in fluid communication with the input port of a flow control device 5 via an ink supply line 6. The flow control device 5 has an output port that is in fluid communication with the primary ink reservoir 4 via a flexible ink supply line 7. In a preferred embodiment of the invention, the flow control device 5 is a pinch clamp which is connected to and controlled by the printer controller 36 via a flow command line 37. The flow control device 5 allows ink to flow from the input port to the output port when it receives an enable-flow signal on the flow command line 37. It stops ink from flowing from the input to the output port when it receives a disable-flow command on the flow command line 37. Thus, signals from the printer controller 36 cause the flow control device 5 to either allow or inhibit the flow of ink from the secondary ink reservoir 10 to the primary ink reservoir 4.

Since the printhead cartridge 2 moves relative to the remote ink cartridge 8 and flow control device 5, the ink supply line 7 is constructed of a resilient material which can endure many flexure cycles. The fluid connection between the output port of the flow control device 5 and the primary ink reservoir 4 may be continuous, as shown in FIG. 1, or intermittent, as in a refill station.

In the preferred embodiment of the invention, since both the printhead cartridge 2 and the remote ink cartridge 8 are replaceable cartridges, a flexible and cost-effective arrangement is provided for the printer user. When a printhead 24 of a printhead cartridge 2 has reached the end of its usable lifetime, it may be replaced by a new printhead cartridge 2 without having to replace the remote ink cartridge 8. Similarly, when the ink in a remote ink cartridge 8 has been depleted, it may be replaced by a new remote ink cartridge 8 without having to replace the printhead cartridge 2. However, some ink formulations, such as dye-based, are incompatible with other formulations, such as pigment-based. Therefore, the flexible arrangement provided by replaceable printhead cartridges and replaceable remote ink cartridges can lead to unfortunate results if the printhead cartridge 2 contains a dissimilar formulation of ink from that provided in the remote ink cartridge 8.

To avoid ink mismatches, the printhead cartridge 2 and the remote ink cartridge 8 are provided with memory devices in which ink-specific information is stored. As shown in FIG. 1, a printhead cartridge memory device 12 is attached to the printhead cartridge 2. In a preferred embodiment, the printhead cartridge memory device 12 is a programmable read-only memory (PROM) device which is programmed during the manufacturing of the printhead cartridge 2. Alternatively, the printhead cartridge memory device 12 may be permanently coded when the device is originally produced (mask ROM). In other embodiments, described in greater detail hereinafter, the printhead cartridge memory device 12 may be a nonvolatile random access memory (NVRAM) device, an erasable programmable read-only memory (EPROM) device, or an electrically-erasable programmable read-only memory (EEPROM) device. When the printhead cartridge 2 is installed in the printer, memory locations within the printhead cartridge memory device 12 are connected to an interface cable 18 by means of a set of contacts 16 on the printhead cartridge 2.

During the process of manufacturing the printhead cartridge 2, after the type and color of ink to be loaded into the printhead cartridge 2 has been determined, first information related to the characteristics of the first quantity of ink is programmed into the printhead cartridge memory device 12. These ink characteristics may include, but are not limited to, ink color, ink formulation, ink volume, ink manufacturing date, ink manufacturing lot number, ink manufacturing plant, ink-specific printhead settings, ink spectral analysis, ink identification number, and printhead identification number.

Also shown in FIG. 1 is a remote ink cartridge memory device 14 attached to the remote ink cartridge 8. In a preferred embodiment, the remote ink cartridge memory device 14 is a PROM device which is programmed during manufacture of the remote ink cartridge 8, or is a mask ROM device which is programmed during manufacture of the device. Alternatively, the remote ink cartridge memory device 12 is an NVRAM, EPROM, or EEPROM device.

Memory locations within the remote ink cartridge memory device 14 are connected to an interface cable 22 by means of a set of contacts 20 on the remote ink cartridge 8 when the remote ink cartridge 8 is installed in the printer.

During the manufacture of the remote ink cartridge 8, after the type and color of ink to be loaded into the remote ink cartridge 8 has been determined, second information related to the characteristics of the second quantity of ink is programmed into the remote ink cartridge memory device 14. As with the printhead cartridge memory device 12, the stored ink characteristics may include, but are not limited to, ink color, ink formulation, ink volume, ink manufacturing date, ink manufacturing lot number, ink manufacturing plant, ink-specific printhead settings, ink spectral analysis, ink identification number, and reservoir identification number.

Figure 2:
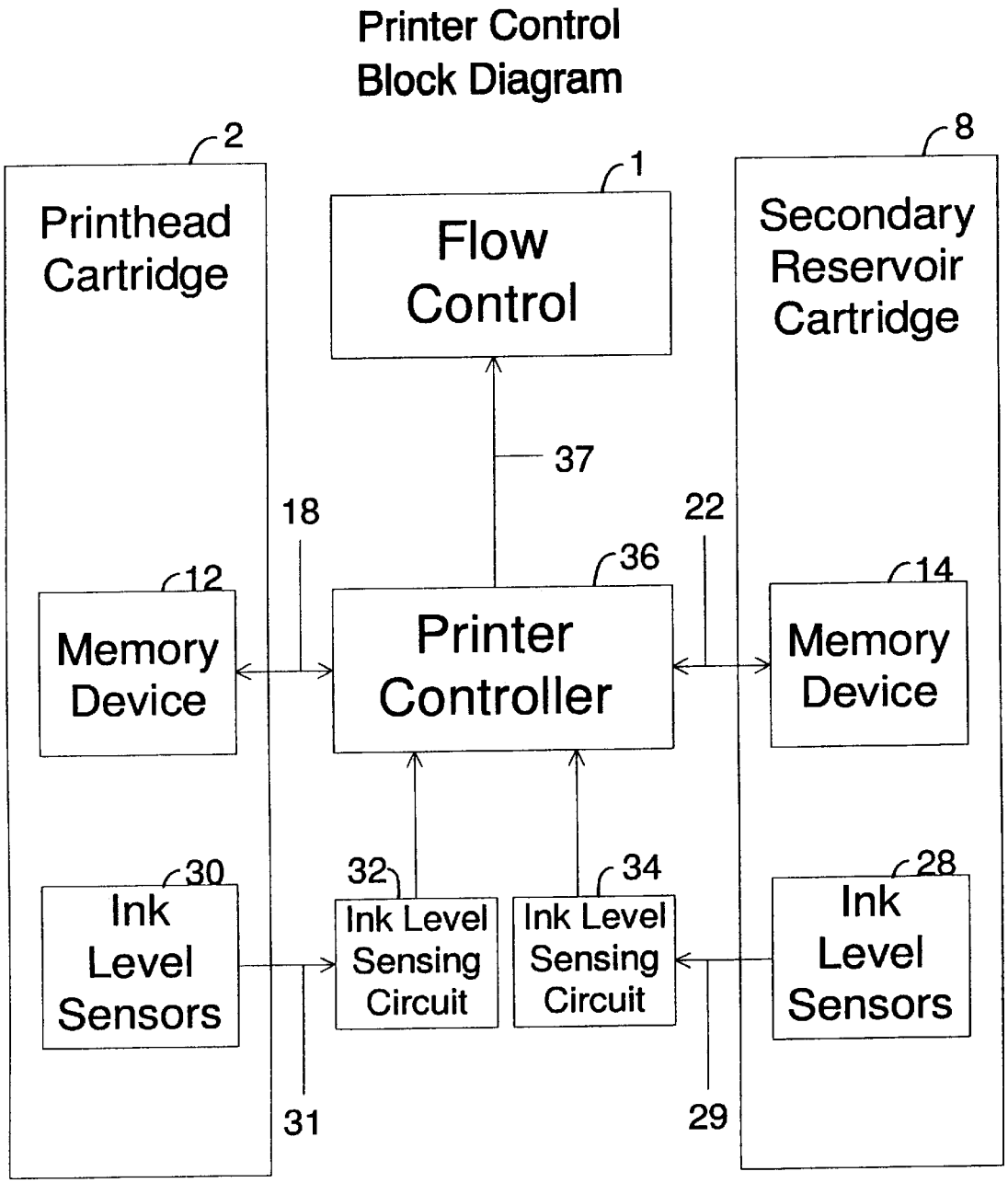
FIG. 2 is a functional block diagram of a printer control system according to a preferred embodiment of the invention.

As shown in FIG. 2, a printer controller 36 has access to the printhead cartridge memory device 12 via the interface cable 18. The printer controller 36 also has access to the remote ink cartridge memory device 14 via the interface cable 22. In the preferred embodiment, the printer controller 36 performs an initial test of the printhead cartridge memory device 12 and the remote ink cartridge memory device 14 to verify proper installation of the printhead cartridge and the remote ink cartridge. If the remote ink cartridge 8 is not properly installed, the interface cable 22 will not make electrical connection with the set of contacts 20 on the remote ink cartridge 8. In the preferred embodiment, if there is no electrical connection between the interface cable 22 and the set of contacts 20, then the printer controller 36 will read all zero's when attempting to access the remote ink cartridge memory device 14. The printer controller 36 interprets all zero's as indicating an improper installation of the remote ink cartridge 8, and generates a message notifying the printer user of the problem. It will be appreciated that, in an alternative embodiment, a reading of all one's could indicate an improper installation. It will also be appreciated that the same scheme is applied to check for proper installation of the printhead cartridge 2.

Figure 3:
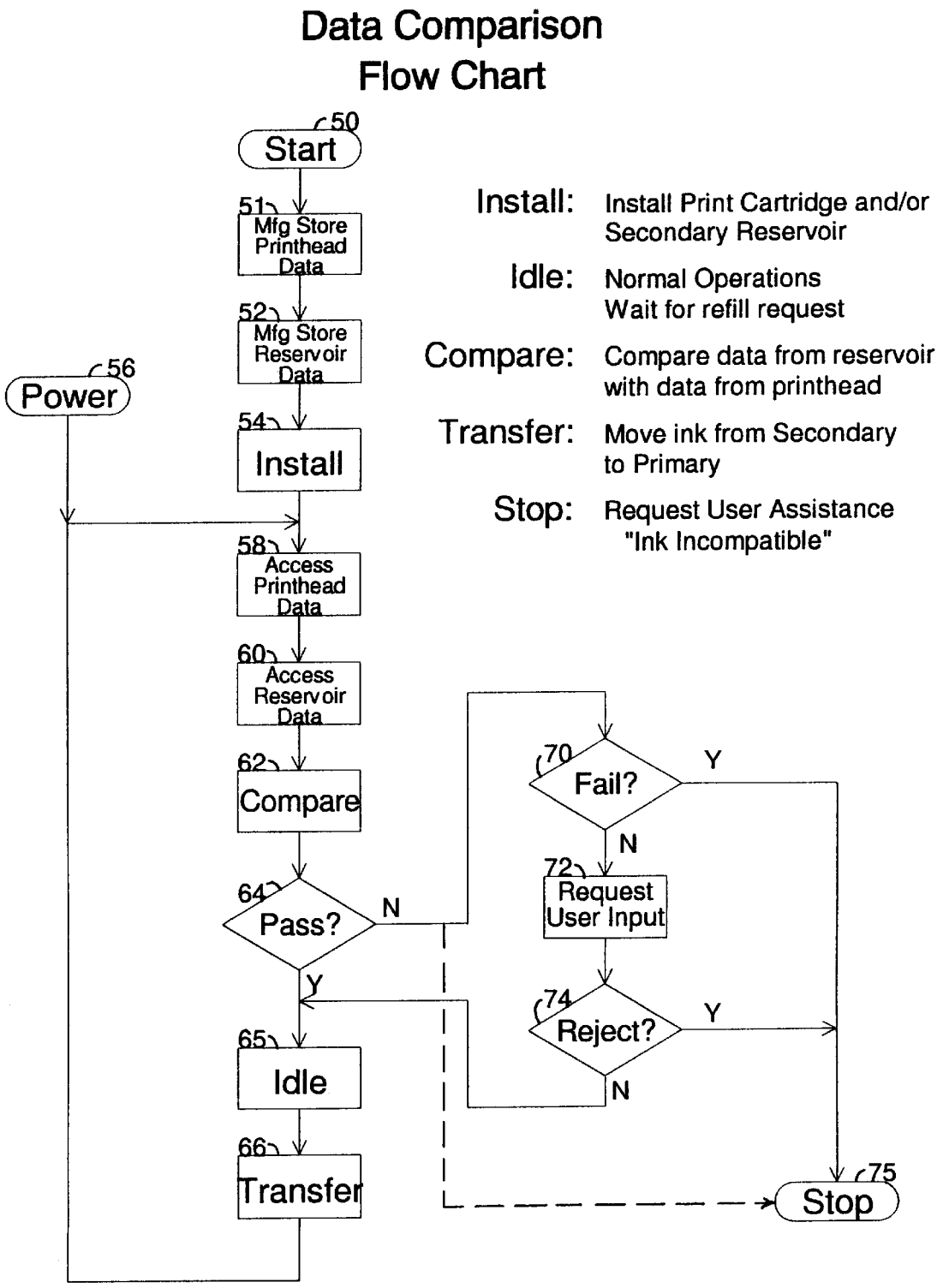
FIG. 3 is a flow diagram of a process for determining compatibility between two ink supplies by comparing information related to the two ink supplies.

Referring now to FIG. 3, the printer controller 36 performs a process to determine whether the second quantity of ink in the remote ink cartridge 8 is compatible with the first quantity of ink in the printhead cartridge 2. In a preferred embodiment of the invention, the printer controller 36 determines compatibility, at least in part, by comparing the color of the second quantity of ink with the color of the first quantity of ink.

As mentioned previously, the first steps in the process of FIG. 3, the storage of the ink color information in the printhead cartridge memory device 12 and the remote ink cartridge memory device 14, are performed during manufacture of these cartridges (steps 51 and 52). In a preferred embodiment, ink color information is specified in RGB (red-green-blue) values, or CMYK (cyan-magenta-yellow-black) values. For the purposes of this description, a 24-bit RGB color specification scheme will be assumed. To encode a particular color in the memory devices, each color is described as a mixture of primary colors red, green, and blue. The intensity of each of the primary colors is specified by an 8-bit value which provides for 256 ($2^8$) intensity levels for each primary color. Thus, in the preferred embodiment, a 24-bit color word is stored in the printhead cartridge memory device 12 and the remote ink cartridge memory device 14.

With continued reference to FIG. 3, when the printhead cartridge 2 and the remote ink cartridge 8 are installed (step 54) and the printer is turned on (step 56), or when either cartridge is installed after the printer is turned on, or when a refill operation is initiated, the printer controller 36 accesses the printhead cartridge memory device 12, reads the 24-bit color word stored therein, and determines the color that is specified by the color word (step 58). For example, the printer controller 36 of the preferred embodiment determines the intensity values for each of the three primary colors based on the color word. In similar fashion, the printer controller 36 accesses the remote ink cartridge memory device 14, reads the 24-bit color word stored therein, and determines the intensity values for each of the three primary colors (step 60).

The printer controller 36 then compares the intensity values for similar primary colors (step 62): the red intensity value from the printhead cartridge color word is compared to the red intensity value from the remote ink cartridge color word; the green intensity value from the printhead cartridge color word is compared to the green intensity value from the remote ink cartridge color word; and the blue intensity value from the printhead cartridge color word is compared to the blue intensity value from the remote ink cartridge color word. Based on these comparisons, intensity difference values are determined for each primary color. If any intensity difference value is nonzero, then the color comparison did not pass at step 64. For example, if the red intensity value from the printhead cartridge color word is 124, and the red intensity value from the remote ink cartridge color word is 128, then the red intensity difference value is four (128−124), and the process continues at step 70.

If the intensity difference value is nonzero, the printer controller 36 determines at step 70 whether or not the intensity difference values for each primary color are substantial. If the intensity difference values for one or more of the primary colors are substantial, then allowing ink from the remote ink cartridge 8 to mix with ink in the printhead cartridge 2 could result in inaccurate color reproduction. Continuing with the previous example, the printer controller 36 compares the red intensity difference value, four, to a maximum difference threshold, say six. Since four is less than the threshold value, the intensity difference is deemed insubstantial and the color comparison passes at step 70. If the other two primary color intensity difference values are also below their thresholds (which may or may not be the same as the red threshold), then the printer controller 36 notifies the user that an insubstantial color mismatch exists, and inquires whether the user wishes to proceed (step 72). If the user rejects the mismatched colors, then printing operations stop and the user is prompted to replace the incompatible remote ink cartridge 8 (step 75).

If any of the primary color intensity difference values exceed their respective thresholds at step 70, then the color difference is deemed substantial. In this case, printing operations stop and the user is prompted to replace the incompatible remote ink cartridge 8 (step 75).

If the intensity difference values are zero at step 64, the process enters an idle state (step 65) and awaits the initiation of an ink transfer (step 66) while other printer operations continue.

In addition to checking color compatibility, the printer controller 36 of the preferred embodiment also checks the compatibility of the formulations of ink in the printhead cartridge 2 and the remote ink cartridge 8. Examples of differing ink formulations include dye-based and pigment-based formulations, and formulations using magnetic particles for magnetic ink character recognition (MICR) applications. With continued reference to FIG. 3, the first steps in this process, the storage of the ink formulation information in the memory devices 12 and 14 (steps 51 and 52), take place during manufacture of the printhead cartridge 2 and the remote ink cartridge 8. In the preferred embodiment, a unique identification number is assigned to each ink formulation. When the printhead cartridge 2 is manufactured, an ink formulation identification number corresponding to the formulation of the first quantity of ink is written into the printhead cartridge memory device 12 (step 51). Similarly, when the remote ink cartridge 8 is manufactured, an ink formulation identification number corresponding to the formulation of the second quantity of ink is written into the remote ink cartridge memory device 14 (step 52). When the printer is turned on, or when a printhead cartridge 2 or a remote ink cartridge 8 is installed after the printer is turned on, or when a refill operation is initiated, the printer controller 36 accesses the printhead cartridge memory device 12 and reads the ink formulation identification number stored therein (step 58). In similar fashion, the printer controller 36 accesses the remote ink cartridge memory device 14 and reads its ink formulation identification number (step 60). The printer controller 36 then compares the printhead cartridge ink formulation identification number to the remote ink cartridge ink formulation identification number (step 62). If the printer controller 36 determines that these numbers match (step 64), then the printer controller 36 generates a signal to cause the process to enter an idle state (step 65). The process remains in the idle state until the printer controller 36 initiates an ink transfer operation (step 66). However, if the ink formulation identification numbers do not match, then the printer controller 36 generates a signal to stop the printer operation (dashed line to step 75). In this situation, the printer controller 36 also generates a message notifying the user that there is an incompatibility between the ink formulations, and requesting user assistance.

In an alternative preferred embodiment, an ink identification number is assigned to a particular ink. The ink identification number indicates several characteristics of the ink, including, but not limited to, color, formulation, lot number, manufacturer, manufacturing date, and special original equipment manufacturer (OEM) requirements. Again referring to FIG. 3, the ink identification number is stored in the remote ink cartridge memory device 14 during manufacture of the remote ink cartridge 8 (step 52). A printhead cartridge identification number is stored in the printhead cartridge memory device 12 (step 51). When the printer is turned on, or when a printhead cartridge 2 or a remote ink cartridge 8 is installed after the printer is turned on, the printer controller 36 accesses the printhead cartridge memory device 12 (step 58), accesses the remote ink cartridge memory device 14 (step 60), and reads the printhead cartridge identification number and the ink identification numbers, respectively. The printer controller 36 then compares the ink identification number against a list of compatible ink identification numbers for the particular printhead cartridge as indicated by the printhead cartridge identification number (step 62). Preferably, the list of ink identification numbers that are compatible with each type of printhead cartridge is contained within a lookup table implemented in printer driver software which controls the operation of the printer controller 36. If the printer controller 36 determines, based on the ink identification number, that the second quantity of ink in the remote ink cartridge 8 is compatible with the printhead cartridge 2 (step 64), then the printer controller 36 generates a signal to cause the process to enter an idle state (step 65). The process remains in the idle state until the printer controller initiates an ink transfer operation (step 66). However, if there is a mismatch at step 64, then the printer controller 36 generates a signal to stop the printer operation (dashed line to step 75), and a message notifying the user that the printhead 24 is incompatible between the printhead 24 and the ink in the remote ink reservoir 10.

For some applications, it may be necessary to match a particular printhead cartridge 2 to a particular remote ink cartridge 8 at the installation of each into an inkjet printer, and to force the pair to remain together throughout the intrinsic lifetime of each. In this situation, it is desirable to assign a unique identification number to the pair, and store this number within the memory devices 12 and 14 of each component. In this manner, the printer controller 36 can compare the stored identification numbers to verify a match.

With continued reference to FIG. 3, during manufacture of the printhead cartridge 2, an identification number, such as a four-byte value, is generated that is unique to the particular printhead cartridge 2. Since the value of this number has no independent significance, it may be generated by a random number generator. However, to maintain uniqueness, the assigned number should be one which has not been previously assigned. The selected number is assigned as the printhead cartridge identification number, and is stored in the printhead cartridge memory device 12, which is a ROM, PROM, NVRAM, EPROM, or EEPROM device (step 51). The same number is assigned as the remote ink cartridge identification number, and is copied to the remote ink cartridge memory device 14, which is also a PROM, NVRAM, EPROM, or EEPROM device (step 52).

When a new printhead cartridge/remote ink cartridge pair has been installed in a printer, when power is turned on, or when a refill operation is initiated, the printer controller 36 accesses the printhead cartridge memory device 12 and reads the printhead cartridge identification number (step 58). The printer controller 36 also accesses the remote ink cartridge memory device 14 and reads the remote ink cartridge identification number (step 60). The printer controller 36 then compares the printhead cartridge identification number to the remote ink cartridge identification number (step 62). If the printer controller 36 determines that these numbers match (step 64), then the printer controller 36 generates a signal to cause the process to enter an idle state (step 65). The process remains in the idle state until the printer controller 36 initiates an ink transfer operation (step 66). However, if the printer controller 36 determines that the cartridge identification numbers do not match (step 64), then the printer controller 36 generates a signal to stop the printer operation (dashed line to step 75). In this situation, the printer controller 36 also generates a message notifying the user that there is an incompatibility between the printhead cartridge 2 and the remote ink cartridge 8.

Figure 4:
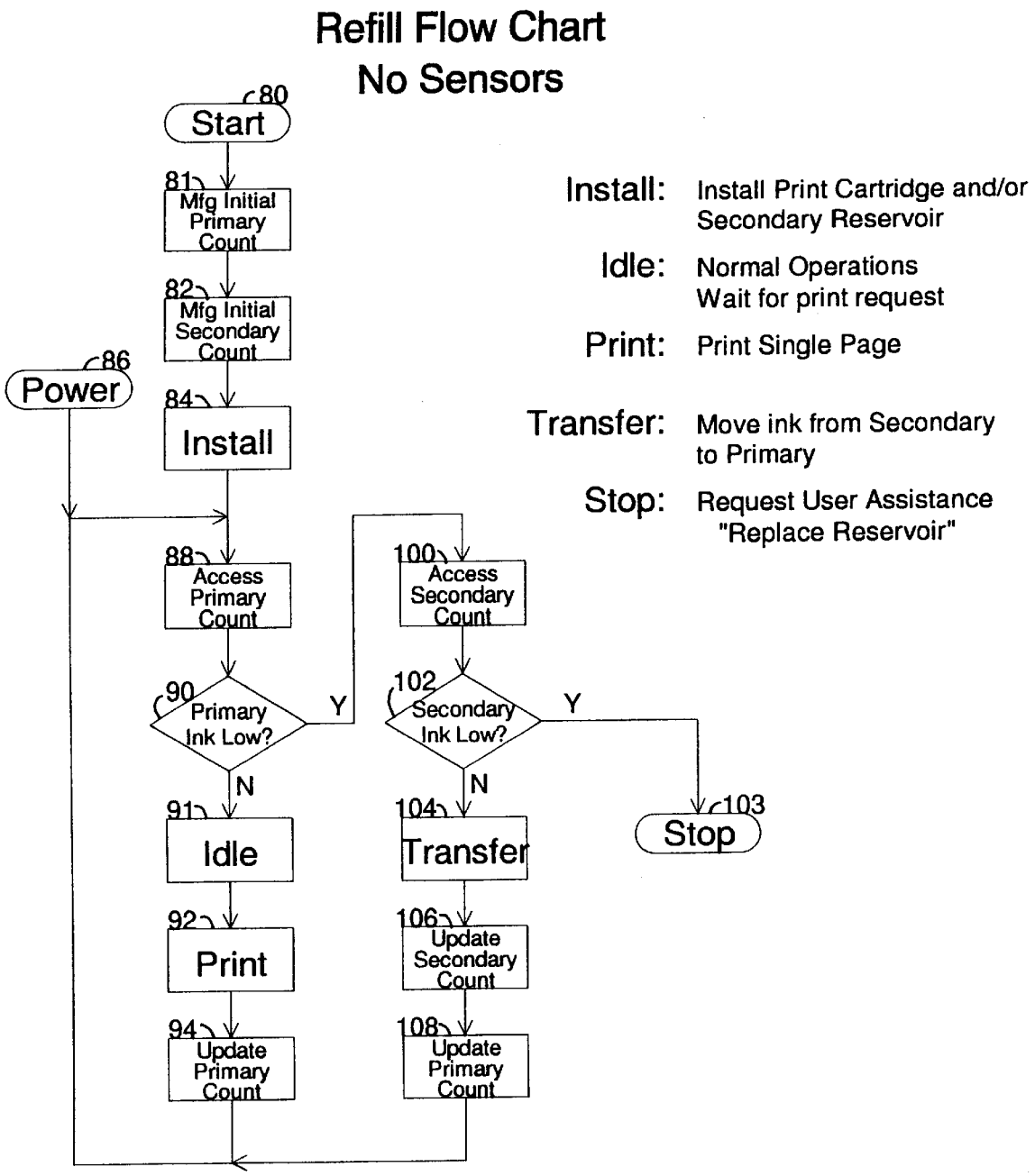
FIG. 4 is a flow diagram of a process for determining when to transfer ink from a secondary ink reservoir to a primary ink reservoir based on ink level information stored with each reservoir.

In an alternative embodiment, the present invention is used to keep track of the level of ink remaining in the primary ink reservoir 4 and the secondary ink reservoir 10. As shown in FIG. 4 at 81, when the primary ink reservoir 4 is filled with ink during manufacture, a stored primary ink level value, representing the initial level of ink in the primary ink reservoir 4, is stored in the printhead cartridge memory device 12. The printhead cartridge memory device 12 of this embodiment is either an EEPROM or NVRAM device which can be updated while the printhead cartridge 2 is installed in the printer. Similarly, a stored secondary ink level value representing the initial level of ink in the secondary ink reservoir 10 is stored in the ink cartridge memory device 14 (step 82), which is also either an EEPROM or NVRAM device. Preferably, the primary and secondary ink level values are ink drop count values which indicate the number of ink drops that can be fired from the printhead given the quantity of ink remaining in the respective reservoir.

After the remote ink cartridge 8 and the printhead cartridge 2 have been installed in the printer (step 84) and the printer power is turned on (step 86), the printer controller 36 accesses the printhead cartridge memory device 12 to retrieve the primary drop count (step 88). The printer controller 36 then compares the primary drop count to a minimum threshold level (step 90). This threshold level represents the amount of ink required to carry out the requested printing task, such as the printing of a page of text. If the primary drop count is greater than the threshold level, then the process enters an idle state (step 91) during which the printer controller 36 awaits a print request. When a print request is received, the printer controller 36 commands the printer to perform the pending printing task, such as printing the page of text (step 92). After completion of the printing task, the printer controller 36 calculates a new primary drop count value and stores the new value in the printhead cartridge memory device 12 (step 94). In the preferred embodiment, this new primary drop count value is calculated by subtracting the number of drops fired in the just-completed printing task from the primary drop count value that was retrieved from the printhead cartridge memory device 12 just prior to performing the printing task. In this manner, a running count of the available ink drops in the primary ink reservoir 4 is maintained in the printhead cartridge memory device 12 for the lifetime of the printhead cartridge 2. If the printhead cartridge 2 is moved from one printer to another, the remaining ink level information travels with it.

With continued reference to FIG. 4, if the printer controller 36 determines at step 90 that the primary drop count is less than the threshold level, then the printer controller 36 accesses the remote ink cartridge memory device 14 and retrieves the secondary drop count (step 100). If the secondary drop count indicates that the secondary ink level is low (step 102), then the printer controller stops the printer operation (step 103) and generates a message requesting user assistance, such as the replacement of the remote ink cartridge 8. If the secondary drop count indicates that the secondary ink level is not low, then ink is transferred from the secondary ink reservoir 10 to the primary ink reservoir 4 (step 104).

The transfer of ink continues for a fixed period of time, such as 30 seconds in the preferred embodiment. This transfer time period is determined by the ratio of the volume of the primary ink reservoir 4 to the rate of ink flow from the secondary ink reservoir 10 to the primary ink reservoir 4. After the ink transfer is completed, the printer controller 36 calculates a new secondary drop count value and stores the new value in the remote ink cartridge memory device 14 (step 106). In the preferred embodiment, this new secondary drop count value is calculated by subtracting the number of just-transferred drops from the secondary drop count value that was retrieved from the remote ink cartridge memory device 14 at step 100. In this manner, a running count of the available ink drops in the secondary ink reservoir 10 is maintained in the remote ink cartridge memory device 14 for the lifetime of the remote ink cartridge 8. As the remote ink cartridge 8 is moved from one printer to another, the remaining ink level information travels with it.

The printer controller 36 also updates the primary drop count after the ink transfer by calculating a new primary drop count value and storing the new value in the printhead cartridge memory device 12 (step 108). The new primary drop count value is calculated by adding the number of just-transferred drops to the primary drop count value that was retrieved from the printhead cartridge memory device 12 at step 90. After updating the secondary and primary drop count values (steps 106 and 108), the process is repeated beginning at step 88.

In yet another embodiment of the invention, as shown in FIGS. 1 and 2, the printhead cartridge 2 includes integral primary ink level sensors 30*a* and 30*b*. These primary ink level sensors 30*a* and 30*b* produce a primary ink level signal related to the level of the first quantity of ink in the primary ink reservoir 4. In a preferred embodiment, the primary ink level signal is proportional to the electrical capacitance between the sensors 30*a* and 30*b*. The sensors 30*a* and 30*b* are connected to a printhead cartridge ink level sensing circuit 32 via an interface cable 31. The ink level sensing circuit 32 determines the level of ink remaining in the primary ink reservoir 4 based on the primary ink level signal, and sends a measured primary ink level value to the printer controller 36.

With continued reference to FIGS. 1 and 2, the remote ink cartridge 8 also includes secondary ink level sensors 28*a*–28*e*. The secondary ink level sensors 28*a*–28*e* produce a secondary ink level signal related to the level of the second quantity of ink in the secondary ink reservoir 10. In a preferred embodiment, the secondary ink level signal is proportional to the electrical capacitance between the sensors 28*a*–28*e*. The sensors 28*a*–28*e* are connected to a remote ink cartridge ink level sensing circuit 34 via an interface cable 29. The ink level sensing circuit 34 determines the level of ink remaining in the secondary ink reservoir 10 based on the secondary ink level signal, and sends a measured secondary ink level value to the printer controller 36.

It will be appreciated that the ink level in either reservoir could be measured based upon resistance instead of capacitance, or based upon other techniques such as measurement of ink weight or volume. It will further be appreciated that fewer or more ink level sensors could be used, the number of sensors affecting only the resolution of the measurement.

Figure 5:
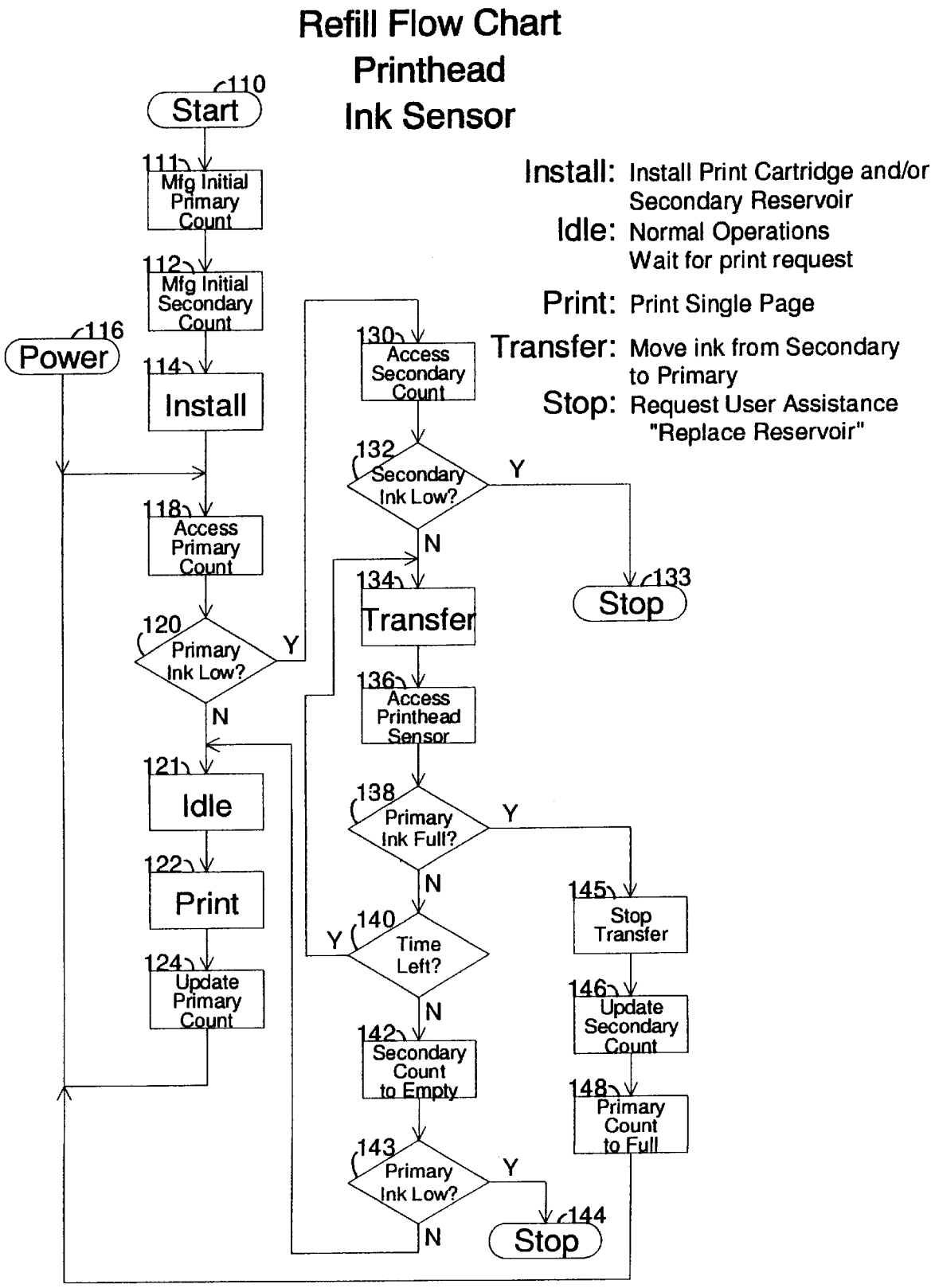
FIG. 5 is a flow diagram of a process for determining when to transfer ink from a secondary ink reservoir to a primary ink reservoir based on ink level information stored with each reservoir, and based on measured ink level information from an ink level sensor in the primary ink reservoir.

FIG. 5 shows a process which uses the stored primary ink level value residing in the printhead cartridge memory device 12 to determine the proper time to refill the primary ink reservoir 4, and which uses the primary ink level sensors 30*a* and 30*b* to determine when the refill is complete. As shown in FIG. 5 at 111, when the primary ink reservoir 4 is filled with ink during manufacture, the stored primary ink level value, representing the initial level of ink in the primary ink reservoir 4, is written to the printhead cartridge memory device 12. Similarly, the stored secondary ink level value representing the initial level of ink in the secondary ink reservoir 10 is written to the remote ink cartridge memory device 14 (step 112). In the preferred embodiment, the stored primary and secondary ink level values are primary and secondary ink drop count values. After the remote ink cartridge 8 and the printhead cartridge 2 have been installed in the printer (step 114) and the printer power is turned on (step 116), the printer controller 36 accesses the printhead cartridge memory device 12 to retrieve the primary drop count value (step 118), and compares the primary drop count value to a first minimum threshold level (step 120). This threshold level represents the amount of ink required to carry out the requested printing task, such as the printing of a page of text. If the primary drop count value is greater than the first minimum threshold level, then the process enters an idle state (step 121) during which the printer controller 36 awaits a print request. When a print request is received, the printer controller 36 commands the printer to perform the pending printing task, such as printing the page of text (step 122). After completion of the printing task, the printer controller 36 calculates a new primary drop count value and stores the new value in the printhead cartridge memory device 12 (step 124). In the preferred embodiment, this new primary drop count value is calculated by subtracting the number of drops fired in the just-completed printing task from the primary drop count value that was retrieved from the printhead cartridge memory device 12 just prior to performing the printing task. In this manner, a running count of the available ink drops in the primary ink reservoir 4 is maintained in the printhead cartridge memory device 12 for the lifetime of the printhead cartridge 2. If the printhead cartridge 2 is moved from one printer to another, the remaining ink level information travels with it.

With continued reference to FIG. 5, if the printer controller 36 determines at step 120 that the primary drop count value is less than the first minimum threshold level, then the printer controller 36 accesses the remote ink cartridge memory device 14 and retrieves the secondary drop count value (step 130). If the secondary drop count value is less than a second minimum threshold (step 132), then the printer controller stops the printer operation (step 133) and generates a message requesting user assistance, such as the replacement of the remote ink cartridge 8. If the secondary drop count value is greater than the second minimum threshold (step 132), the printer controller 36 sends an enable-flow signal over the flow command line 37 to the flow control device 5, and ink is transferred from the secondary ink reservoir 10 to the primary ink reservoir 4 (step 134).

During the ink transfer, the printer controller 36 receives the measured primary ink level value from the printhead cartridge ink level sensing circuit 32 indicating the measured level of ink in the primary ink reservoir 4 (step 136). As described above, the measured primary ink level value is based upon the level of ink measured by the primary ink level sensors 30*a* and 30*b*, and is independent of the drop count value stored in the printhead cartridge memory device 12. If the measured primary ink level value indicates that the primary ink reservoir 4 is not yet full (step 138), then the printer controller 36 waits for a predetermined time period (step 140), such as one second, while ink continues to transfer from the secondary ink reservoir 10 to the primary ink reservoir 4 (step 134).

If, after the wait period, the measured primary ink level value indicates that the ink level in the primary ink reservoir 4 has increased compared to the most recent previous measurement (step 136), but the reservoir 4 is not yet full (step 138), then the loop continues (steps 134–136–138–140). However, if the measured primary ink level value indicates that the reservoir 4 is not full, and the ink level in the reservoir 4 has not increased compared to the most recent previous measurement (step 136), then the secondary ink reservoir 10 is assumed to be empty. In this situation, printer controller 36 sets the secondary drop count value in the remote ink cartridge memory device 14 to zero (step 142). The printer controller 36 then compares the primary drop count value to the first minimum threshold level (step 143). If the primary drop count value is greater than the first minimum threshold level, then the process returns to the idle state at step 121. If the primary drop count value is less than the first minimum threshold level, then the printer controller 36 stops printer operations (step 144) and generates a message indicating that user intervention is required, such as replacement of the remote ink cartridge 8.

With continued reference to FIG. 5, if the measured primary ink level value indicates that the primary ink reservoir 4 is full (step 138), then the printer controller 36 sends a disable-flow signal to the flow control device 5 to stop the transfer of ink (step 145). The secondary drop count value (stored in the ink cartridge memory device 14) is then updated to indicate the remaining level of ink in the secondary ink reservoir 10 after the completion of the ink transfer (step 146). In the preferred embodiment, this new secondary drop count value is calculated by subtracting the number of just-transferred drops from the secondary drop count value that was retrieved from the remote ink cartridge memory device 14 at step 130. The printer controller 36 also updates the primary drop count stored in the printhead cartridge memory device 12 to a value indicating a full reservoir (step 148). After updating the secondary and primary drop count values (steps 146 and 148), the process is repeated beginning at step 118.

Figure 6:
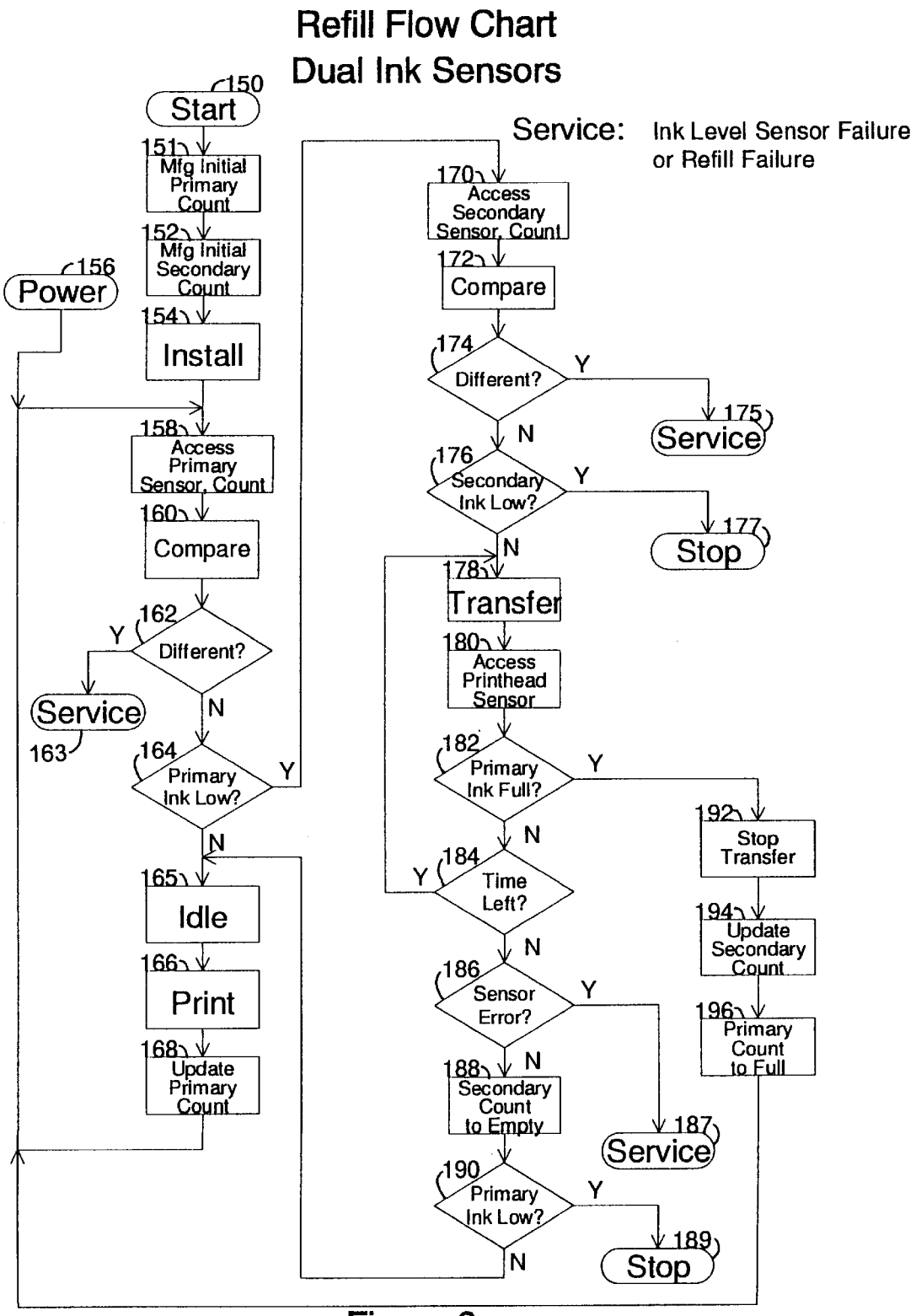
FIG. 6 is a flow diagram of a process for determining when to transfer ink from a secondary ink reservoir to a primary ink reservoir based on ink level information stored with each reservoir, and based on measured ink level information from ink level sensors in each reservoir.

In an alternative embodiment of the invention, the printhead cartridge memory device 12, and the remote ink cartridge memory device 14 provide means for determining the integrity of measurements produced by integrated ink level sensors such as those described above. Referring now to FIG. 6, when the primary ink reservoir 4 is filled with ink during manufacture, the stored primary ink level value, such as the primary drop count value representing the initial level of ink in the primary ink reservoir 4, is written to the printhead cartridge memory device 12 (step 151). Similarly, a stored secondary ink level value, such as the secondary drop count value representing the initial level of ink in the secondary ink reservoir 10, is written to the remote ink cartridge memory device 14 (step 152). After the remote ink cartridge 8 and the printhead cartridge 2 have been installed in the printer (step 154) and the printer power is turned on (step 156), the printer controller 36 accesses the printhead cartridge memory device 12 to retrieve the stored primary ink level value (step 158). The printer controller 36 also receives the measured primary ink level value from the ink level sensing circuit 32 indicating the level of ink in the primary ink reservoir as sensed by the primary ink level sensors 30*a*–30*b*. The printer controller 36 then compares the measured primary ink level value to the stored primary ink level value (step 160). If the primary ink level sensors 30*a*–30*b* are functioning properly, and the correct stored primary ink level value was written to the print cartridge memory device 12 at step 151, then the two ink level values will match. If these ink level values do not match, then either one or more primary ink level sensors 30*a*–30*b* have failed, or an inaccurate primary ink level value was stored. If the printer controller 36 determines that the two ink level values differ by a significant amount (step 162), then the printer controller 36 generates a system fault message indicating to the user that service is required (step 163). At this point, the user does not have enough information to know which ink level value is correct, and further diagnosis of the problem is required.

If the printer controller 36 determines that the two ink level values match, then the printer controller 36 compares the primary drop count value to a first minimum threshold level (step 164). This threshold level represents the amount of ink required to carry out the requested printing task, such as the printing of a page of text. If the primary drop count value is greater than the first minimum threshold level, then the process enters an idle state (step 165) during which the printer controller 36 awaits a print request. When a print request is received, the printer controller 36 commands the printer to perform the pending printing task, such as printing the page of text (step 166). After completion of the printing task, the printer controller 36 calculates a new primary drop count value and stores the new value in the printhead cartridge memory device 12 (step 168). In the preferred embodiment, this new primary drop count value is calculated by subtracting the number of drops fired in the just-completed printing task from the primary drop count value that was retrieved from the printhead cartridge memory device 12 just prior to performing the printing task. After updating the primary drop count value (step 168), the process is repeated beginning at step 158.

With continued reference to FIG. 6, if the printer controller 36 determines at step 164 that the primary drop count value is less than the first minimum threshold level, then the printer controller 36 accesses the remote ink cartridge memory device 14 and retrieves the secondary drop count value (step 170). The printer controller 36 also receives the measured secondary ink level value from the ink level sensing circuit 34 indicating the level of ink in the secondary ink reservoir 10 as sensed by the secondary ink level sensors 28*a*–28*e*. The printer controller 36 then compares the measured secondary ink level value to the stored secondary ink level value (step 172). If the secondary ink level sensors 28*a*–28*e* are functioning properly, and the correct secondary ink level value was written to the remote ink cartridge memory device 14 at step 152, then the two ink level values will match. If these ink level values do not match, then either one or more secondary ink level sensors 28*a*–28*e* have failed, or an inaccurate secondary ink level value was stored. If the printer controller 36 determines that the two ink level values differ by a significant amount (step 174), then the printer controller 36 generates a system fault message indicating to the user that service is required (step 175). At this point, the user does not have enough information to know which ink level value is correct, and further diagnosis of the problem is required.

If the printer controller 36 determines at step 174 that the two ink level values match, then the printer controller 36 compares the secondary drop count value to the second minimum threshold level (step 176). If the secondary drop count value is less than the second minimum threshold level, then the printer controller 36 stops the printer operation (step 177) and generates a message requesting user assistance, such as the replacement of the remote ink cartridge 8. If the secondary drop count value is greater than the second minimum threshold level, then the printer controller 36 sends an enable-flow signal to the flow control device 5, and ink is transferred from the secondary ink reservoir 10 to the primary ink reservoir 4 (step 178).

During the ink transfer, the printer controller 36 receives the measured primary ink level value from the printhead cartridge ink level sensing circuit 32 indicating the measured level of ink in the primary ink reservoir 4 (step 180). If, the measured primary ink level value indicates that the primary ink reservoir 4 is not yet full (step 182), then the printer controller 36 waits a predetermined time period (step 184), such as one second, while ink continues to transfer from the secondary ink reservoir 10 to the primary ink reservoir 4 (step 178).

If, after the wait period, the measured primary ink level value indicates that the ink level in the primary ink reservoir 4 has increased compared to the most recent previous measurement (step 180), but the reservoir 4 is not yet full (step 182), then the loop continues (steps 178–180–182–184). However, if the measured primary ink level value indicates that the reservoir 4 is not full, and the ink level in the reservoir 4 has not increased compared to the most recent previous measurement (step 180), then the printer controller 36 checks the measured secondary ink level value from the secondary reservoir ink level sensing circuit 34 to determine whether the secondary ink reservoir 10 is empty (step 186).

If the measured secondary ink level value indicates that the reservoir 10 is empty (step 186), then the printer controller 36 sets the secondary drop count value in the remote ink cartridge memory device 14 to zero (step 188). The printer controller 36 then compares the primary drop count value to the first minimum threshold level (step 190). If the primary drop count value is greater than the first minimum threshold level, then the process returns to the idle state at step 165. If the primary drop count value is less than the first minimum threshold level, then the printer controller 36 stops printer operations (step 189) and generates a message indicating that user intervention is required, such as replacement of the remote ink cartridge 8. However, if the measured secondary ink level value indicates that the reservoir 10 is not empty (step 186), then the printer controller 36 generates a message indicating to the user that there has either been a failure of one or more secondary ink level sensors 28*a*–28*e* or that there has been a refill failure, and that service is required (step 187).

With continued reference to FIG. 6, if the measured primary ink level value indicates that the primary ink reservoir 4 is full (step 182), then the printer controller 36 sends a disable-flow signal to the flow control device 5 to stop the transfer of ink (step 192). The secondary drop count value (stored in the ink cartridge memory device 14) is then updated to indicate the remaining level of ink in the secondary ink reservoir 10 after the completion of the ink transfer (step 194). In the preferred embodiment, this new secondary drop count value is calculated by subtracting the number of just-transferred drops from the secondary drop count value that was retrieved from the remote ink cartridge memory device 14 at step 170. The printer controller 36 also updates the primary drop count value stored in the printhead cartridge memory device 12 to a value indicating a full reservoir (step 196). After updating the secondary and primary drop count values (steps 194 and 196), the process is repeated beginning at step 158.

Figure 7:
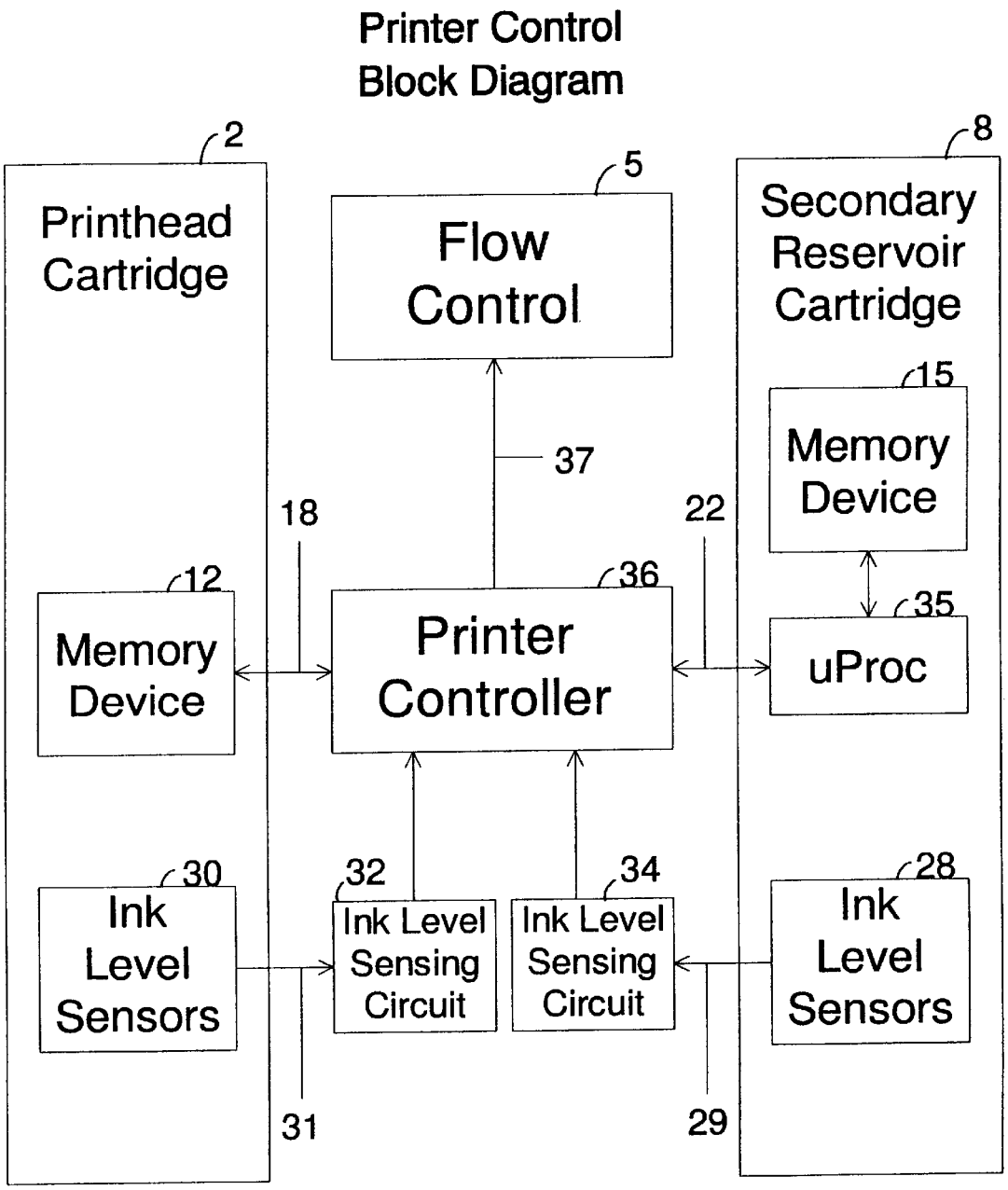
FIG. 7 is a functional block diagram of a printer control system according to an alternative embodiment of the invention.

In an alternative embodiment as shown in FIG. 7, the remote ink cartridge 8 includes a computer processor 35 between the printer controller 36 and the ink cartridge memory device 15. The memory device 15 of this embodiment is preferably a NVRAM device. Alternatively, the processor 35 and a EEPROM memory device 15 are integrated into a single package, such as a device manufactured by Toshiba having a model number of TMP47E186M. In either case, the processor 35 executes software instructions which implement any or all of the previously described methods (summarized in FIGS. 3, 4, 5, and 6) for checking compatibility between the remote ink cartridge 8 and the printhead cartridge 2, for tracking the ink levels in the primary and secondary ink reservoirs 4 and 10, and for comparing ink levels determined by drop count values to ink levels determined by sensor measurements. Since these methods are performed by software stored within the ink cartridge processor 35 instead of within the printer controller 36, driver software in the printer controller 36 need not be changed for each new ink color or formulation, or for ink cartridge design changes. This embodiment has the further advantage of protecting the NVRAM memory device 15 from spurious write cycles from the printer controller 36.

Although the ink level sensing circuit 34 shown in FIGS. 2 and 7 is separate from the remote ink cartridge 8, it will be appreciated that the sensing circuit 34 could be integrated with the remote ink cartridge 8. In the latter configuration, the measured secondary ink level value from the sensing circuit 34 is sent to the ink cartridge microprocessor 35 instead of to the printer controller 36.

It is contemplated, and will be apparent to those skilled in the art from the preceding description and the accompanying drawings that modifications and additions may be made in the embodiments of the invention. Accordingly, it is expressly intended that the foregoing description and the accompanying drawings are illustrative of preferred embodiments only, not limiting thereto, and that the spirit and scope of the invention be determined by reference to the following claims.

What is claimed is:

1. An apparatus for comparing characteristics of an inkjet printhead cartridge with characteristics of a remote ink cartridge, the apparatus comprising:

a printhead disposed on the printhead cartridge, the printhead having an array of nozzles, each nozzle having an ejection element for causing ink in the nozzle to be ejected from the nozzle and onto a print medium;

a primary ink reservoir disposed on the inkjet printhead cartridge, the primary ink reservoir containing a first quantity of ink in fluid communication with the array of nozzles;

a printhead cartridge memory device which stores first information related to characteristics of the printhead cartridge, the printhead memory device disposed on the inkjet printhead cartridge;

a secondary ink reservoir disposed on the remote ink cartridge, the secondary ink reservoir containing a second quantity of ink in intermittent fluid communication with the primary ink reservoir;

a remote ink cartridge memory device which stores second information related to characteristics of the remote ink cartridge, the remote ink cartridge memory device disposed on the remote ink cartridge; and a printer controller that interfaces at least with the printhead, the printhead cartridge memory device, and the remote ink cartridge memory device, that accesses the first information from the printhead cartridge memory device, that accesses the second information from the remote ink cartridge memory device, that compares the first information to the second information, that determines the compatibility of the printhead cartridge and the remote ink cartridge, and that generates printer control signals according to the compatibility of the printhead cartridge and the remote ink cartridge.

2. The apparatus of claim 1 wherein:

the first information is further related to characteristics of the first quantity of ink;

the second information is further related to characteristics of the second quantity of ink; and the printer controller determines the compatibility of the printhead cartridge and the remote ink cartridge by determining the compatibility of thc first quantity of ink and the second quantity of ink, and generates printer control signals according to the compatibility of the of the first quantity of ink and the second quantity of ink.

3. The apparatus of claim 1 wherein the printhead cartridge memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

4. The apparatus of claim 1 wherein the ink cartridge memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

5. An apparatus for comparing characteristics of an inkjet printhead cartridge with characteristics of a remote ink cartridge, the apparatus comprising:

a printhead disposed on the inkjet printhead cartridge, the printhead having an array of nozzles, each nozzle having an ejection element for causing ink in the nozzle to be ejected from the nozzle and onto a print medium;

a primary ink reservoir disposed on the inkjet printhead cartridge, the primary ink reservoir containing a first quantity of ink in fluid communication with the array of nozzles;

a printhead cartridge memory device which stores first information related to characteristics of the first quantity of ink, the printhead cartridge memory device selected from the group consisting of read-only memory (ROM), electrically-erasable programmable read-only memory (EEPROM), and non-volatile random-access memory (NVRAM) devices, the printhead cartridge memory device disposed on the inkjet printhead cartridge;

a secondary ink reservoir disposed on the remote ink cartridge, the secondary ink reservoir containing a second quantity of ink in intermittent fluid communication with the primary ink reservoir;

a remote ink cartridge memory device which stores second information related to characteristics of the second quantity of ink, the remote ink cartridge memory device selected from the group consisting of read-only memory (ROM), electrically-erasable programmable read-only memory (EEPROM), and non-volatile random-access memory (NVRAM) devices, the remote ink cartridge memory device disposed on the remote ink cartridge; and a printer controller that interfaces at least with the printhead, the printhead cartridge memory device and the remote ink cartridge memory device, that accesses the first information from the printhead cartridge memory device, that accesses the second information from the remote ink cartridge memory device, that compares the first information to the second information, that determines the compatibility of the first quantity of ink and the second quantity of ink, and that generates printer control signals according to the compatibility of the first quantity of ink and the second quantity of ink.

6. An apparatus for comparing characteristics of an inkjet printhead cartridge with characteristics of a remote ink cartridge, the apparatus comprising:

a printhead disposed on the printhead cartridge, the printhead having an array of nozzles, each nozzle having an ejection element for causing ink in the nozzle to be ejected from the nozzle and onto a print medium;

a primary ink reservoir disposed on the printhead cartridge, the primary ink reservoir containing a first quantity of ink in fluid communication with the array of nozzles;

a printhead cartridge memory device which stores first information related to characteristics of the printhead cartridge, the printhead cartridge memory device disposed on the printhead cartridge;

a secondary ink reservoir disposed on the remote ink cartridge, the secondary ink reservoir containing a second quantity of ink in intermittent fluid communication with the primary ink reservoir;

a remote ink cartridge memory device which stores second information related to characteristics of the remote ink cartridge, the remote ink cartridge memory device disposed on the remote ink cartridge;

a printer controller that interfaces at least with the printhead, the printhead cartridge memory device, and a remote ink cartridge processor, and that accesses the first information from the printhead cartridge memory device; and a remote ink cartridge processor disposed on the remote ink cartridge that interfaces at least with the remote ink cartridge memory device and the printer controller, that accesses the first information from the printer controller, that accesses the second information from the remote ink cartridge memory device, that compares the first information to the second information, that determines the compatibility of the printhead cartridge and the remote ink cartridge, and that generates printer control signals according to the compatibility of the printhead cartridge and the remote ink cartridge.

7. The apparatus of claim 6 wherein:

the first information is further related to characteristics of the first quantity of ink;

the second information is further related to characteristics of the second quantity of ink; and the remote ink cartridge processor determines the compatibility of the printhead cartridge and the remote ink cartridge by determining the compatibility of the first quantity of ink and the second quantity of ink, and generates printer control signals according to the compatibility of the of the first quantity of ink and the second quantity of ink.

8. The apparatus of claim 6 wherein the printhead cartridge memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

9. The apparatus of claim 6 wherein the remote ink cartridge memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

10. An apparatus for storing information relating to amounts of ink contained within an inkjet printhead cartridge and within a remote ink cartridge, the apparatus comprising:

a primary ink reservoir disposed on the printhead cartridge, the primary ink reservoir for holding a first quantity of ink;

a printhead cartridge memory device which stores a stored primary ink level value related to the level of the first quantity of ink, the printhead cartridge memory device disposed on the printhead cartridge;

a secondary ink reservoir disposed on the remote ink cartridge, the secondary ink reservoir for holding a second quantity of ink in intermittent fluid communication with the primary ink reservoir;

a remote ink cartridge memory device which stores a stored secondary ink level value related to the level of the second quantity of ink, the remote ink cartridge memory device disposed on the remote ink cartridge; and a printer controller that interfaces at least with the printhead cartridge memory device and the remote ink cartridge memory device, that accesses the stored primary ink level value from the printhead cartridge memory device, that accesses the stored secondary ink level value from the remote ink cartridge memory device, that determines the level of the first quantity of ink based on the stored primary ink level value, that determines the level of the second quantity of ink based on the stored secondary ink level value, and that generates printer control signals according to the levels of the first and second quantities of ink.

11. The apparatus of claim 10 wherein the printhead cartridge memory device is selected from the group consisting of electrically-erasable programmable read-only memory (EEPROM) and non-volatile random-access memory (NVRAM) devices.

12. The apparatus of claim 10 wherein the ink cartridge memory device is selected from the group consisting of programmable read-only memory (PROM), erasable programmable read-only memory (EPROM), electrically-erasable programmable read-only memory (EEPROM), and non-volatile random-access memory (NVRAM) devices.

13. The apparatus of claim 10 wherein the stored primary ink level value and the stored secondary ink level value are ink drop count values.

14. The apparatus of claim 10 further comprising:

a flow control device connected between the secondary ink reservoir and the primary ink reservoir, the flow control device electrically connected to the printer controller via a flow command line, the flow control device enabling fluid flow from the secondary ink reservoir to the primary ink reservoir upon receipt of an enable-flow signal on the flow command line, and the flow control device precluding fluid flow from the secondary ink reservoir to the primary ink reservoir upon receipt of a disable-flow signal on the flow command line; and the printer controller issuing an enable-flow signal on the flow command line when the stored primary ink level value is less than a minimum threshold, and issuing a disable-flow signal on the flow command line after an ink transfer period has elapsed.

15. The apparatus of claim 10 wherein the printer controller updates the stored primary ink level value in the printhead cartridge memory device when the level of the first quantity of ink has changed, and updates the stored secondary ink level value in the remote ink cartridge memory device when the level of the second quantity of ink has changed.

16. The apparatus of claim 10 further comprising:

at least one primary ink level sensor disposed on the primary ink reservoir, the at least one primary ink level sensor producing a primary ink level signal related to the level of the first quantity of ink;

a printhead cartridge ink level sensing circuit electrically connected to the at least one primary ink level sensor, the printhead cartridge ink level sensing circuit receiving the primary ink level signal, determining a measured level of the first quantity of ink based on the primary ink level signal, and generating a measured primary ink level value indicative of the measured level of the first quantity of ink; and the printer controller receiving the measured primary ink level value from the printhead cartridge ink level sensing circuit.

17. The apparatus of claim 16 further comprising:

a flow control device connected between the secondary ink reservoir and the primary ink reservoir, the flow control device electrically connected to the printer controller via a flow command line, the flow control device enabling fluid flow from the secondary ink reservoir to the primary ink reservoir upon receipt of an enable-flow signal on the flow command line, and the flow control device precluding fluid flow from the secondary ink reservoir to the primary ink reservoir upon receipt of a disable-flow signal on the flow command line; and the printer controller issuing an enable-flow signal on the flow command line when the stored primary ink level value is less than a minimum threshold, and issuing a disable-flow signal on the flow command line when the measured primary ink level value indicates that the primary ink reservoir is full.

18. The apparatus of claim 16 wherein the printer controller compares the measured primary ink level value to the stored primary ink level value, and generates printer control signals based upon the comparison.

19. The apparatus of claim 18 wherein the printer controller generates a system fault message indicating a primary ink level sensor fault when the measured primary ink level value does not match the stored primary ink level value.

20. The apparatus of claim 10 further comprising:

at least one secondary ink level sensor disposed on the secondary ink reservoir, the at least one secondary ink level sensor producing a secondary ink level signal related to the level of the second quantity of ink;

a remote ink cartridge ink level sensing circuit electrically connected to the at least one secondary ink level sensor, the remote ink cartridge ink level sensing circuit receiving the secondary ink level signal, determining a measured level of the second quantity of ink based on the secondary ink level signal, and generating a measured secondary ink level value indicative of the measured level of the second quantity of ink; and the printer controller receiving the measured secondary ink level value from the remote ink cartridge ink level sensing circuit.

21. The apparatus of claim 20 wherein the printer controller compares the measured secondary ink level value to the stored secondary ink level value, and generates printer control signals based upon the comparison.

22. The apparatus of claim 21 wherein the printer controller generates a system fault message indicating a secondary ink level sensor fault when the measured secondary ink level value does not match the stored secondary ink level value.

23. An apparatus for storing information relating to amounts of ink contained within an inkjet printhead cartridge and within a remote ink cartridge, the apparatus comprising:

a primary ink reservoir disposed on the printhead cartridge, the primary ink reservoir containing a first quantity of ink;

a printhead cartridge memory device which stores a stored primary ink level value related to the level of the first quantity of ink, the printhead cartridge memory device disposed on the inkjet printhead cartridge, the printhead cartridge memory device selected from the group consisting of electrically-erasable programmable read-only memory (EEPROM) and non-volatile random-access memory (NVRAM) devices, a secondary ink reservoir disposed on the remote ink cartridge, the secondary ink reservoir containing a second quantity of ink;

a remote ink cartridge memory device which stores a stored secondary ink level value related to the level of the second quantity of ink, the remote ink cartridge memory device disposed on the remote ink cartridge, the remote ink cartridge memory device selected from the group consisting of programmable read-only memory (PROM), erasable programmable read-only memory (EPROM), electrically-erasable programmable read-only memory (EEPROM), and non-volatile random-access memory (NVRAM) devices;

a flow control device connected between the secondary ink reservoir and the primary ink reservoir, the flow control device electrically connected to a printer controller via a flow command line, the flow control device enabling fluid flow from the secondary ink reservoir to the primary ink reservoir upon receipt of an enable-flow signal on the flow command line, and the flow control device precluding fluid flow from the secondary ink reservoir to the primary ink reservoir upon receipt of a disable-flow signal on the flow command line; and the printer controller interfacing at least with the printhead cartridge memory device and the remote ink cartridge memory device, the printer controller accessing the stored primary ink level value from the printhead cartridge memory device, accessing the stored secondary ink level value from the remote ink cartridge memory device, determining the level of the first quantity of ink based on the stored primary ink level value, determining the level of the second quantity of ink based on the stored secondary ink level value, issuing an enable-flow signal on the flow command line when the stored primary ink level value is less than a minimum threshold, issuing a disable-flow signal on the flow command line after an ink transfer period has elapsed, updating the stored primary ink level value in the printhead cartridge memory device when the level of the first quantity of ink has changed, and updating the stored secondary ink level value in the remote ink cartridge memory device when the level of the second quantity of ink has changed.

24. An ink cartridge which is remotely located relative to an inkjet printhead in an inkjet printer, the cartridge comprising:

a secondary ink reservoir;

ink for use in the inkjet printer, the ink disposed within the secondary ink reservoir;

an ink cartridge memory device disposed on the secondary ink reservoir for storing information related to characteristics of the ink;

a computer processor disposed on the secondary ink reservoir, the computer processor interfaced with the memory device and with a printer controller in the inkjet printer, the computer processor determining, based upon the information related to characteristics of the ink, whether the ink is compatible with the printhead.

25. The ink cartridge of claim 24 wherein the memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

26. The ink cartridge of claim 24 wherein the memory device and the computer processor are integrated into a single device disposed on the secondary ink reservoir.

27. An apparatus for storing information relating to amounts of ink contained within an inkjet printhead cartridge and within a remote ink cartridge, the apparatus comprising:

a primary ink reservoir disposed on the printhead cartridge, the primary ink reservoir containing a first quantity of ink;

a printhead cartridge memory device which stores a stored primary ink level value related to the level of the first quantity of ink, the printhead cartridge memory device disposed on the printhead cartridge;

a secondary ink reservoir disposed on the remote ink cartridge, the secondary ink reservoir containing a second quantity of ink in intermittent fluid communication with the primary ink reservoir;

a remote ink cartridge memory device which stores a stored secondary ink level value related to the level of the second quantity of ink, the remote ink cartridge memory device disposed on the remote ink cartridge;

a remote ink cartridge processor disposed on the remote ink cartridge that interfaces with at least the remote ink cartridge memory device and a printer controller, that accesses the stored secondary ink level value from the remote ink cartridge memory device, that determines the level of the second quantity of ink based on the stored secondary ink level value, and that generates printer control signals according to the level of the second quantity of ink; and a printer controller that interfaces at least with the printhead cartridge memory device and the remote ink cartridge processor, that accesses the stored primary ink level value from the printhead cartridge memory device, that determines the level of the first quantity of ink based on the stored primary ink level value, and that generates printer control signals according to the level of the first quantity of ink.

28. The apparatus of claim 27 wherein the printhead cartridge memory device is selected from the group consisting of programmable read-only memory (PROM), erasable programmable read-only memory (EPROM), electrically-erasable programmable read-only memory (EEPROM), and non-volatile random-access memory (NVRAM) devices.

29. The apparatus of claim 27 wherein the remote ink cartridge memory device is selected from the group consisting of read-only memory (ROM), electrically-erasable programmable read-only memory (EEPROM), and non-volatile random-access memory (NVRAM) devices.

30. The apparatus of claim 27 wherein the remote ink cartridge memory device and the remote ink cartridge processor are integrated into a single device disposed on the remote ink cartridge.

31. The apparatus of claim 27 wherein the stored primary ink level value and the stored secondary ink level value are ink drop count values.

32. The apparatus of claim 27 further comprising:

a flow control device connected between the secondary ink reservoir and the primary ink reservoir, the flow control device electrically connected to the printer controller via a flow command line, the flow control device enabling fluid flow from the secondary ink reservoir to the primary ink reservoir upon receipt of an enable-flow signal on the flow command line, and the flow control device precluding fluid flow from the secondary ink reservoir to the primary ink reservoir upon receipt of a disable-flow signal on the flow command line; and the printer controller issuing an enable-flow signal on the flow command line when the stored primary ink level value is less than a minimum threshold, and issuing a disable-flow signal on the flow command line after an ink transfer period has elapsed.

33. The apparatus of claim 27 wherein the printer controller updates the stored primary ink level value in the printhead cartridge memory device when the level of the first quantity of ink has changed.

34. The apparatus of claim 27 wherein the remote ink cartridge processor updates the stored secondary ink level value in the remote ink cartridge memory device when the level of the second quantity of ink has changed.

35. The apparatus of claim 27 further comprising:

at least one primary ink level sensor disposed on the primary ink reservoir, the at least one primary ink level sensor producing a primary ink level signal related to the level of the first quantity of ink;

a printhead cartridge ink level sensing circuit electrically connected to the at least one primary ink level sensor, the printhead cartridge ink level sensing circuit receiving the primary ink level signal, determining a measured level of the first quantity of ink based on the primary ink level signal, and generating a measured primary ink level value indicative of the measured level of the first quantity of ink; and the printer controller receiving the measured primary ink level value from the printhead cartridge ink level sensing circuit.

36. Thc apparatus of claim 35 further comprising:

a flow control device connected between the secondary ink reservoir and the primary ink reservoir, the flow control device electrically connected to the printer controller via a flow command line, the flow control device enabling fluid flow from the secondary ink reservoir to the primary ink reservoir upon receipt of an enable-flow signal on the flow command line, and the flow control device precluding fluid flow from the secondary ink reservoir to the primary ink reservoir upon receipt of a disable-flow signal on the flow command line; and the printer controller issuing an enable-flow signal on the flow command line when the stored primary ink level value is less than a minimum threshold, and issuing a disable-flow signal on the flow command line when the measured primary ink level value indicates that the primary ink reservoir is full.

37. The apparatus of claim 35 wherein the printer controller compares the measured primary ink level value to the stored primary ink level value, and generates printer control signals based upon the comparison.

38. The apparatus of claim 37 wherein the printer controller generates a system fault message indicating a primary ink level sensor fault when the measured primary ink level value does not match the stored primary ink level value.

39. The apparatus of claim 27 further comprising:

at least one secondary ink level sensor disposed on the secondary ink reservoir, the at least one secondary ink level sensor producing a secondary ink level signal related to the level of the second quantity of ink; and a remote ink cartridge ink level sensing circuit electrically connected to the at least one secondary ink level sensor, the remote ink cartridge ink level sensing circuit receiving the secondary ink level signal, determining a measured level of the second quantity of ink based on the secondary ink level signal, and generating a measured secondary ink level value indicative of the measured level of the second quantity of ink.

40. The apparatus of claim 39 wherein the printer controller receives the measured secondary ink level value from the remote ink cartridge ink level sensing circuit, compares the measured secondary ink level value to the stored secondary ink level value, and generates printer control signals based upon the comparison.

41. The apparatus of claim 40 wherein the printer controller generates a system fault message indicating a secondary ink level sensor fault when the measured secondary ink level value does not match the stored secondary ink level value.

42. The apparatus of claim 39 wherein the remote ink cartridge processor receives the measured secondary ink level value from the remote ink cartridge ink level sensing circuit, compares the measured secondary ink level value to the stored secondary ink level value, and generates printer control signals based upon the comparison.

43. The apparatus of claim 42 wherein the remote ink cartridge processor generates a system fault message indicating a secondary ink level sensor fault when the measured secondary ink level value does not match the stored secondary ink level value.

44. An apparatus for storing information relating to amounts of ink contained within an inkjet printhead cartridge and within a remote ink cartridge, the apparatus comprising:

a primary ink reservoir disposed on the printhead cartridge, the primary ink reservoir containing a first quantity of ink;

a printhead cartridge memory device which stores a stored primary ink level value related to the level of the first quantity of ink, the printhead cartridge memory device disposed on the printhead cartridge, the printhead cartridge memory device selected from the group consisting of electrically-erasable programmable read-only memory (EEPROM) and non-volatile random-access memory (NVRAM) devices, a secondary ink reservoir disposed on the remote ink cartridge, the secondary ink reservoir containing a second quantity of ink;

a remote ink cartridge memory device which stores a stored secondary ink level value related to the level of the second quantity of ink, the remote ink cartridge memory device disposed on the remote ink cartridge, the remote ink cartridge memory device selected from the group consisting of programmable read-only memory (PROM), erasable programmable read-only memory (EPROM), electrically-erasable programmable read-only memory (EEPROM), and non-volatile random-access memory (NVRAM) devices;

a flow control device connected between the secondary ink reservoir and the primary ink reservoir, the flow control device electrically connected to a printer controller via a flow command line, the flow control device enabling fluid flow from the secondary ink reservoir to the primary ink reservoir upon receipt of an enable-flow signal on the flow command line, and the flow control device precluding fluid flow from the secondary ink reservoir to the primary ink reservoir upon receipt of a disable-flow signal on the flow command line; and a remote ink cartridge processor that interfaces with at least the remote ink cartridge memory device and a printer controller, that accesses the stored secondary ink level value from the remote ink cartridge memory device, determines the level of the second quantity of ink based on the stored secondary ink level value, and updates the stored secondary ink level value in the remote ink cartridge memory device when the level of the second quantity of ink has changed; and the printer controller interfacing at least with the printhead cartridge memory device and the remote ink cartridge processor, the printer controller accessing the stored primary ink level value from the printhead cartridge memory device, determining the level of the first quantity of ink based on the stored primary ink level value, issuing an enable-flow signal on the flow command line when the level of the first quantity of ink is less than a minimum threshold, issuing a disable-flow signal on the flow command line after an ink transfer period has elapsed, and updating the stored primary ink level value in the printhead cartridge memory device when the level of the first quantity of ink has changed.

45. An apparatus for comparing characteristics of an inkjet printhead cartridge with characteristics of a remote ink cartridge, the apparatus comprising:

a printhead disposed on the printhead cartridge, the printhead having an array of nozzles, each nozzle having an ejection element for causing ink in the nozzle to be ejected from the nozzle and ejected ink onto a print medium;

a primary ink reservoir disposed on the printhead cartridge, the primary ink reservoir in fluid communication with the array of nozzles;

a first quantity of ink having first characteristics and disposed within the primary ink reservoir;

a printhead cartridge memory device which stores first information related to the first characteristics, the printhead cartridge memory device disposed on the printhead cartridge;

a secondary ink reservoir disposed on the remote ink cartridge, the secondary ink reservoir in intermittent fluid communication with the primary ink reservoir;

a second quantity of ink having second characteristics and disposed within the secondary ink reservoir;

a remote ink cartridge memory device which stores second information related to the second characteristics, the remote ink cartridge memory device disposed on the remote ink cartridge; and a printer controller that interfaces at least with the printhead, the printhead cartridge memory device, and the remote ink cartridge memory device, that accesses the first information from the printhead cartridge memory device, that accesses the second information from the remote ink cartridge memory device, that compares the first information to the second information, that determines the compatibility of the printhead cartridge and the remote ink cartridge, and that generates printer control signals according to the compatibility of the printhead cartridge and the remote ink cartridge.

46. The apparatus of claim 45 wherein the printhead cartridge memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

47. The apparatus of claim 45 wherein the remote ink cartridge memory device is selected from the group consisting of read-only memory (ROM), programmable read-only memory (PROM), erasable programmable read-only memory (EPROM), electrically-erasable programmable read-only memory (EEPROM), and non-volatile random-access memory (NVRAM) devices.

48. The apparatus of claim 10 further comprising:

the first quantity of ink disposed within the primary ink reservoir; and the second quantity of ink disposed within the secondary ink reservoir.

49. A method of controlling an inkjet printer having multiple ink reservoirs that supply ink to a single printhead, the method comprising the steps of:

storing first information in a first memory device, the first information indicative of characteristics of a first quantity of ink contained in a primary ink reservoir;

storing second information in a second memory device, the second information indicative of characteristics of a second quantity of ink contained in a secondary ink reservoir;

accessing the first memory device to retrieve the first information;

accessing the second memory device to retrieve the second information;

determining the characteristics of the first quantity of ink based upon the first information;

determining the characteristics of the second quantity of ink based upon the second information;

comparing the characteristics of the first quantity of ink with the characteristics of the second quantity of ink;

determining the compatibility of the first quantity of ink with the second quantity of ink based upon the comparison of the characteristics of the first quantity of ink with the characteristics of the second quantity of ink;

generating a printer control signal based upon the compatibility of the first quantity of ink with the second quantity of ink; and controlling the printer in response to the printer control signal.

50. The method of claim 49 wherein the first information and second information are indicative of one or more characteristics of ink selected from the group consisting of ink color, ink formulation, ink manufacturing date, ink manufacturing lot number, ink manufacturing plant, ink-specific printhead settings, ink spectral analysis, ink identification number, ink reservoir capacity, and ink level.

51. The method of claim 50 wherein the step of comparing the characteristics of the first quantity of ink with the characteristics of the second quantity of ink further comprises comparing the color of the first quantity of ink with the color of the second quantity of ink.

52. The method of claim 51 wherein the step of determining the compatibility of the first quantity of ink with the second quantity of ink further comprises determining a color difference between the color of the first quantity of ink and the color of the second quantity of ink.

53. The method of claim 52 wherein the step of generating a printer control signal further comprises:

continuing printer operation when the color difference is nonexistent;

pausing printer operation and asking the user whether printer operation should continue when the color difference is insubstantial; and halting printer operation and eliciting user intervention when the color difference is substantial.

54. The method of claim 50 wherein the step of comparing the characteristics of the first quantity of ink with the characteristics of the second quantity of ink further comprises comparing the formulation of the first quantity of ink with the formulation of the second quantity of ink.

55. The method of claim 54 wherein the step of determining the compatibility of the first quantity of ink with the second quantity of ink further comprises determining whether the formulation of the first quantity of ink is the same as the formulation of the second quantity of ink.

56. The method of claim 55 wherein the step of generating a printer control signal further comprises:

continuing printer operation when the formulation of the first quantity of ink is the same as the formulation of the second quantity of ink; and halting printer operation and eliciting user intervention when the formulation of the first quantity of ink is not the same as the formulation of the second quantity of ink.

57. A method of controlling an inkjet printer having a primary ink reservoir containing a first quantity of ink and a secondary ink reservoir containing a second quantity of ink, the method comprising the steps of:

(a) storing first information in a first memory device disposed on the primary ink reservoir, the first information indicative of a level of the first quantity of ink;

(b) storing second information in a second memory device disposed on the secondary ink reservoir, the second information indicative of a level of the second quantity of ink;

(c) accessing the first memory device to retrieve the first information;

(d) accessing the second memory device to retrieve the second information;

(e) determining a stored level of the first quantity of ink based upon the first information;

(f) determining a stored level of the second quantity of ink based upon the second information;

(g) comparing the stored level of the first quantity of ink to a first minimum value;

(h) comparing the stored level of the second quantity of ink to a second minimum value;

(i) transferring ink from the secondary ink reservoir to the primary ink reservoir when the stored level of the first quantity of ink is less than the first minimum value and the stored level of the second quantity of ink equals or exceeds the second minimum value;

(j) continuing printer operation when the stored level of the first quantity of ink equals or exceeds the first minimum value; and (k) stopping printer operation and eliciting user intervention when the stored level of the second quantity of ink is less than the second minimum value.

58. The method of claim 57 further comprising:

(l) step (i) including transferring ink from the secondary ink reservoir to the primary ink reservoir for a predetermined time period;

(m) determining a measured level of the first quantity of ink at the end of the predetermined time period by measuring the level of the first quantity of ink using an ink level sensor; and (n) repeating steps (l) and (m) until the measured level of the first quantity of ink indicates that the primary ink reservoir is full.

59. The method of claim 57 further comprising the steps of:

determining a measured level of the first quantity of ink by measuring the level of the first quantity of ink using an ink level sensor;

comparing the measured level of the first quantity of ink with the stored level of the first quantity of ink; and stopping printer operation and eliciting user intervention when the measured level of the first quantity of ink differs from the stored level of the first quantity of ink.

60. The method of claim 57 further comprising the steps of:

determining a measured level of the second quantity of ink by measuring the level of the second quantity of ink using an ink level sensor;

comparing the measured level of the second quantity of ink with the stored level of the second quantity of ink; and stopping printer operation and eliciting user intervention when the measured level of the second quantity of ink differs from the stored level of the second quantity of ink.

61. The method of claim 62 further comprising:

(o) step (i) including transferring ink from the secondary ink reservoir to the primary ink reservoir for a predetermined time period;

(p) determining a measured level of the first quantity of ink at the end of the predetermined time period by measuring the level of the first quantity of ink using an ink level sensor;

(q) repeating steps (o) and (p) until the measured level of the first quantity of ink indicates that the level of the first quantity of ink has not increased compared to the most recent previous measuring of the level of the first quantity of ink; and (r) when the measured level of the first quantity of ink indicates that the level of the first quantity of ink has not increased compared to the most recent previous measuring of the level of the first quantity of ink, determining a measured level of the second quantity of ink.

62. The method of claim 61 further comprising stopping printer operation and eliciting user intervention when the measured level of the second quantity of ink determined at step (r) indicates that the secondary ink reservoir is empty.

63. The method of claim 61 further comprising stopping printer operation and eliciting user intervention when the measured level of the second quantity of ink determined at step (r) indicates that the level of the second quantity of ink has not decreased compared to the most recent previous measuring of the level of the second quantity of ink.

64. A method of controlling an inkjet printer having a remote ink reservoir supplying ink to a printhead cartridge, the method comprising the steps of:

storing a first identification number in a first memory device on the printhead cartridge;

storing a second identification number in a second memory device on the remote ink reservoir;

accessing the first memory device to retrieve the first identification number;

accessing the second memory device to retrieve the second identification number;

comparing the first identification number to the second identification number;

determining the compatibility of the printhead cartridge with the remote ink reservoir based upon the comparison of the first identification number to the second identification number;

generating a printer control signal based upon the compatibility of the printhead cartridge with the remote ink reservoir; and controlling the printer in response to the printer control signal.

65. The method of claim 64 wherein the step of determining the compatibility of the printhead cartridge with the remote ink reservoir further comprises determining whether the first and second identification numbers are equivalent.

66. The method of claim 65 wherein the step of generating a printer control signal further comprises:

continuing printer operation when the first and second identification numbers arc equivalent; and halting printer operation and eliciting user intervention when first and second identification numbers are not equivalent.

* * * * *